United States Patent [19]

Kaufman et al.

[11] Patent Number: 4,485,608

[45] Date of Patent: Dec. 4, 1984

[54] PREFABRICATED, SELF-CONTAINED BUILDING AND METHOD OF CONSTRUCTION

[75] Inventors: Charles E. Kaufman, Old Greenwich, Conn.; Marvin R. Shetler, Scotts Mills, Oreg.; William M. Sharp, Stamford, Conn.

[73] Assignee: Restroom Facilities Corporation, Reno, Nev.

[21] Appl. No.: 397,919

[22] Filed: Jul. 13, 1982

[51] Int. Cl.[3] ..... E04G 21/14; E04B 1/348

[52] U.S. Cl. ..... 52/745; 52/79.1; 52/79.9; 52/125.3; 156/71; 156/91; 156/92

[58] Field of Search ..... 52/79.1, 79.9, 90, 92, 52/745, 125.2, 233, 264, 274, 656; 156/71, 91, 92

[56] References Cited

U.S. PATENT DOCUMENTS

| | | | |
|---|---|---|---|
| 678,728 | 7/1901 | George | 52/92 |
| 1,143,047 | 6/1915 | Greer | 52/92 |
| 1,445,738 | 2/1923 | Adams | 52/233 |
| 1,448,244 | 3/1923 | Wilson | 52/92 |
| 2,563,703 | 8/1951 | Bonney | 52/233 |
| 3,983,669 | 10/1976 | Bogaert | 52/200 |
| 4,110,952 | 9/1978 | Blachura | 52/745 |

FOREIGN PATENT DOCUMENTS

| | | | |
|---|---|---|---|
| 496375 | 2/1978 | Australia | 52/92 |

*Primary Examiner*—Alfred C. Perham

*Attorney, Agent, or Firm*—Mattern, Ware, Stoltz & Fressola

[57] ABSTRACT

By providing a fully equipped, prefabricated, self-contained building, completely constructed with all exterior and interior walls and roof, but having no floor, floor members or floor-supporting members, a unique, prefabricated, preconstructed, self-contained building is achieved, ready for installation on a floor forming foundation to complete the building construction. In the preferred embodiment, the prefabricated, preconstructed building incorporates an interlocking tenon and mortise construction at each interconnecting corner of intersecting wall members. In addition, the building of the present invention also incorporates a triple thick frame construction along the base of the building and a double thick frame construction along the top of the walls of the building, all of which combine with the mortise and tenon interconnections to provide the desired structural rigidity to enable the prefabricated, self-contained building to be lifted in its entirety and moved into position on the floor-forming foundation.

15 Claims, 16 Drawing Figures

21
20
24
24
23
29
29
29

46
45
47
44
40
41
36
39
49
41
42
38
34
43
72
34
48
42
34
37
71
33
20
42
31
35
32
32
30

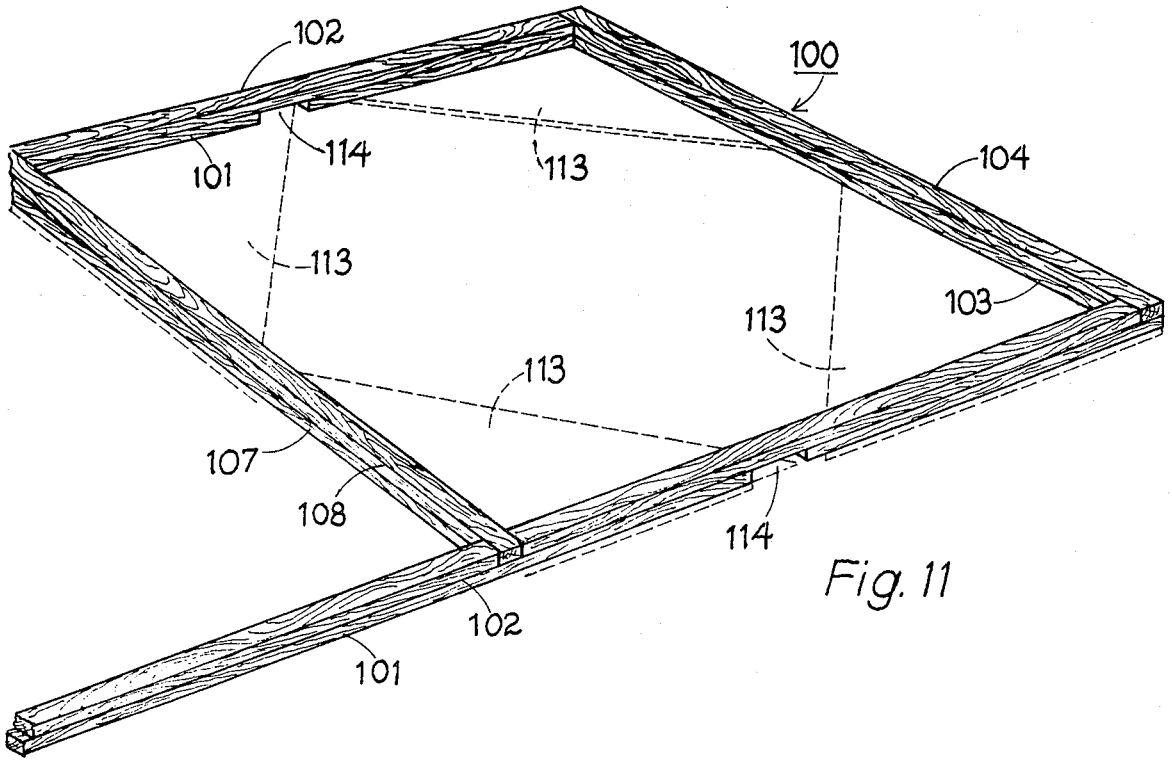
Fig. 11
Fig. 12
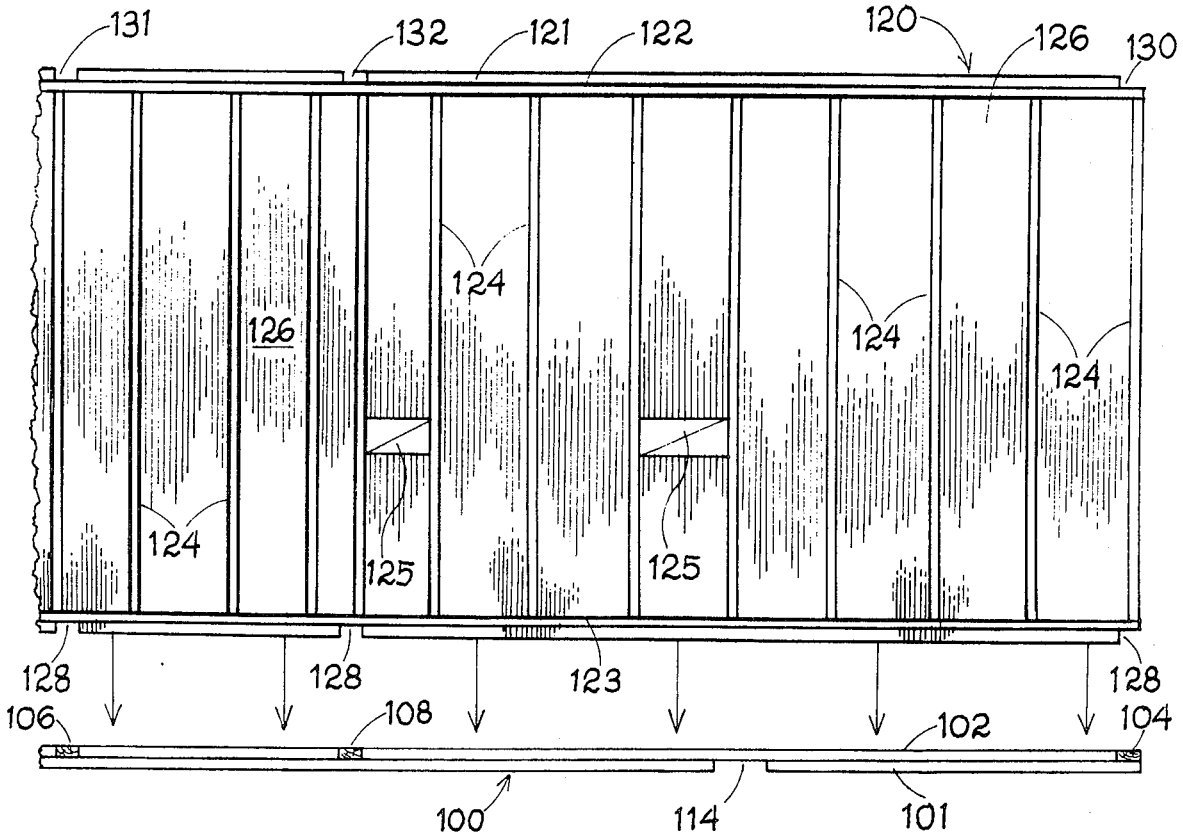

PREFABRICATED, SELF-CONTAINED BUILDING AND METHOD OF CONSTRUCTION

TECHNICAL FIELD

This invention relates to prefabricated, preconstructed buildings, and more particularly to such building and the construction methods for efficiently and economically prefabricating a building structure which can be transported and lifted, in its entirety, even though the building structure is completely devoid of any floor-forming members.

BACKGROUND ART

Due to the increasing cost continuously being encountered in the construction of buildings at a particular site, much effort has been expended in developing prefabricated modular pieces for expediting the intensive labor effort required in building construction. In fact, these prior art systems have evolved to the achievement of prefabricated modular units which can be either stacked one on top of the other to form high-rise structures, or interconnected horizontally to form a completed building structure. In addition, many of these preconstructed modules are fully equipped with plumbing and electricity.

However, in spite of the massive effort that has been expended in developing efficient modular constructions, all of the prior art prefabricated modules require the use of floor joists or completed floor structures as part of the modular construction. In addition, these prior art constructions employ the floor supports as the major load-carrying means to be used in the transportation, movement and installation of the modular units. As a result, additional labor and materials are required, increasing the cost of the building as well as the construction time required.

Furthermore, these prior art systems are incapable of being fully constructed from modularized panel members. This is principally due to the dependency on a floor for support and the total lack of any strong, securable interconnection between preformed panels.

In addition, prior art structures have also failed to provide a completely prefabricated, preconstructed building which is entirely self-contained, ready for being lifted from the transportation means, and placed on its foundation as the final step in completing the entire installation of the building.

Consequently, a principal object of the present invention is to provide a preconstructed, prefabricated, self-contained building which can be lifted in its entirety even though the building has no floor or floor-supporting members.

Another object of the present invention is to provide a prefabricated, preconstructed, self-contained building having the characteristic features defined above wherein the building is completely installed by merely moving the building from transportation means to a preconstructed floor-forming foundation.

Another object of the present invention is to provide a prefabricated, preconstructed, self-contained building having the characteristic features defined above wherein the preformed foundation incorporates all necessary plumbing and electrical connections which are quickly and easily interconnected to the building's corresponding systems.

A further object of the present invention is to provide a prefabricated, preconstructed, self-contained building having the characteristic features defined above, wherein said building is capable of being constructed from preformed modular panels which are quickly and easily matingly interconnected to form a building of the desired size and shape.

Other and more specific objects will in part be obvious and will in part hereinafter.

DISCLOSURE OF THE INVENTION

By employing the present invention the prior art deficiencies are overcome and a complete, prefabricated, preconstructed, self-contained building is attained, which has no floor or floor-supporting members, and which incorporates a triple thick base frame construction and a double thick top wall frame construction in order to provide the requisite structural rigidity. Preferably, the building is constructed from preformed wall panels, which incorporate all doorways framed therein, with said wall panel having one side thereof completed with the desired interior wall treatment. In addition, each wall panel is constructed with frame interlocking means formed at each end thereof in order to matingly engage and securely interconnect with an adjacent wall panel, at both the top and bottom corners thereof.

Using the present invention, wall panels of the most common dimension can be prefabricated for subsequent assembly. When a building is to be constructed, the wall panels having the desired dimensions and design are selected and interconnected with each other, to form the desired overall building shape and interior arrangement. Then, the building is completed with all the interior equipment necessary for the building mounted therein, with complete plumbing and electrical systems installed. Finally, remaining construction is completed, and a fully prefabricated, self-contained, floorless building is attained.

Once completed, the building of the present invention is transported to the site where the building is to be installed. Prior to the building's transportation, a floor-forming foundation is constructed with all necessary electrical and plumbing connections incorporated therein. Then, the building need only be lifted and removed from the transportation means, positioned over the foundation, and placed thereon. Once in position, the building's electrical and plumbing systems are quickly and easily interconnected with the site's systems and the building is ready for use.

By employing the present invention, buildings of any size and shape can be prefabricated as a self-contained unit, transported to the desired location and quickly and easily installed into position, ready for use. Typically, buildings of the present invention weigh between five and twenty-five tons and, in spite of this weight, are easily lifted from the transportation means using conventional cranes, and easily placed on the preformed foundation.

Due to the inherent structural rigidity achieved by the construction techniques of the present invention, the building suffers no damage during the installation process, provided the lifting notches formed in the triple reinforced bottom peripherally surrounding base frame are employed for the lifting and positioning of the building.

Due to the construction of the building of the present invention from preconstructed wall panels, a building of any desired configuration or layout can be attained. Of course, if desired, wall panels employing the present invention can be constructed for any particular purpose or for any special designs. Consequently, the present invention can be employed for construction of any type of building with any desired layout or configuration, without departing from the scope of this invention.

The invention accordingly comprises the several steps and the relation of one or more steps with respect to each of the other, and the article possessing the features, properties, and relation of elements which are exemplified in the following detailed disclosure, and the scope of the invention will be indicated in the claims.

THE DRAWINGS

For a fuller understanding of the nature and objects of the invention, reference should be made to the following detailed description taken in connection with the accompanying drawings in which:

FIG. 11 is a perspective view of a frame construction used in an alternate embodiment for the construction of the building of the present invention;

FIG. 12 is a rear elevation view, partially broken away, showing a sidewall panel in the process of being affixed to the base of FIG. 11;

BEST MODE FOR CARRYING OUT THE INVENTION

Figure 1:
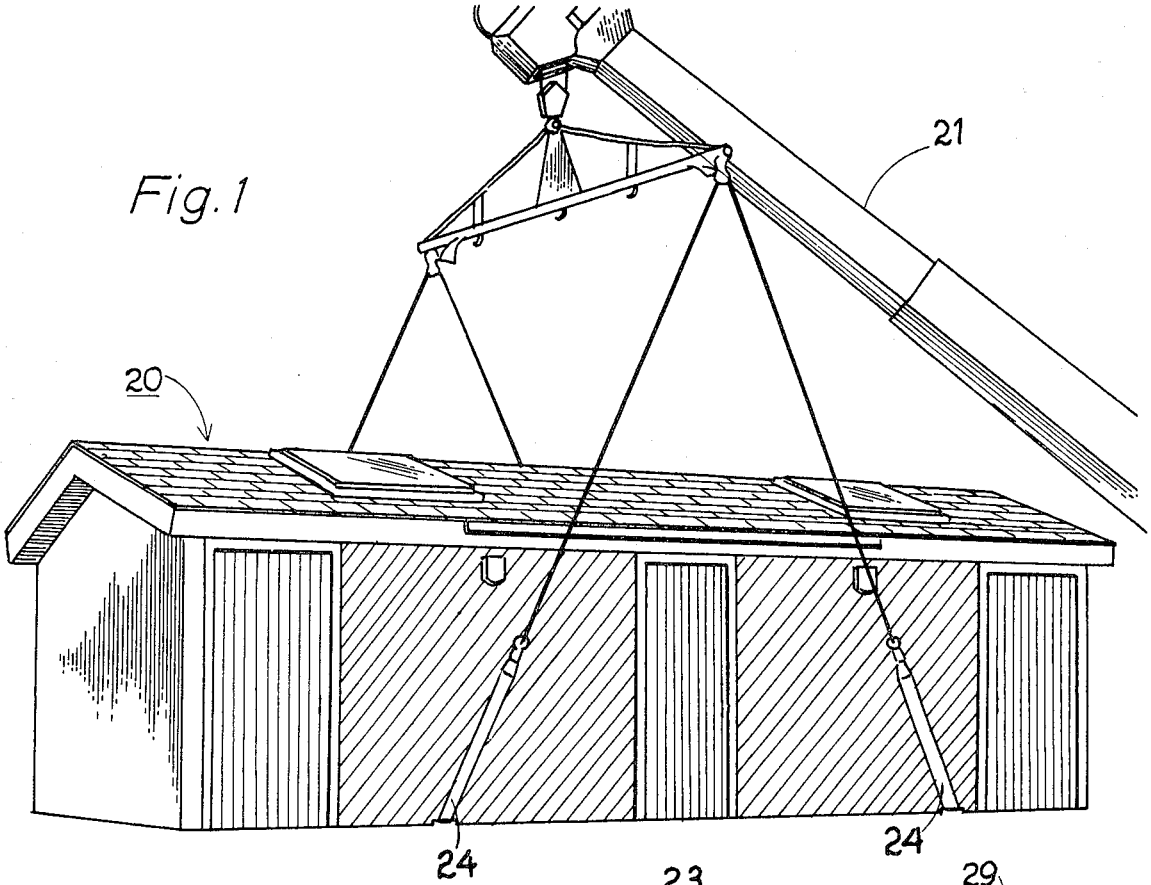
FIG. 1 is a perspective view of the prefabricated, preconstructed, bottomless building of the present invention in the process of being lowered onto its foundation.

In FIG. 1, prefabricated, fully constructed floorless building 20 of the present invention is shown being lowered by crane system 21 in position upon slab foundation 23, fully supported by strap means 24 connected to crane 21. By employing the teaching of the present invention, building 20 is completely constructed at a remote location and transported, preferably by truck, to the installation site. As shown in FIG. 1, building 20 is installed at the site by lifting the entire building 20 from its transportation means, positioning building 20 above the concrete slab foundation 23 upon which building 20 is to rest, and then lowering building 20 into position. Then, necessary plumbing connections are made and, with a minimum of effort, building 20 is fully and completely installed, ready for use or occupation. Since building 20 does not have any floor-forming members, foundation 23 becomes the floor once building 20 is placed thereon.

As is readily apparent from the disclosure of the present invention, the prefabricated, preconstructed building and method of construction, defined and claimed herein, can be employed for many alternate building structures, including, but not limited to, individual or multiple residential dwellings, individual or multiple bungalows, cabins, or motel rooms, individual or multiple business units for offices, laboratories, or retail establishments, and individual or multiple restaurant facilities. In view of the high cleanliness standards, plumbing requirements, and concentrated equipment and fixture requirements that are necessary in constructing a fully operational restroom facility, the prefabricated, preconstructed building 20 of the present invention will be disclosed and described herein for use as a restroom facility. However, the following disclosure and description is intended to be and should be interpreted as illustrative of a single type of building construction for which the present invention may be employed. In addition, prefabricated, preconstructed building 20 will be described as a preconstructed building housing two separate restroom facilities at opposed ends thereof with a central utility room incorporated therebetween.

Figure 2:
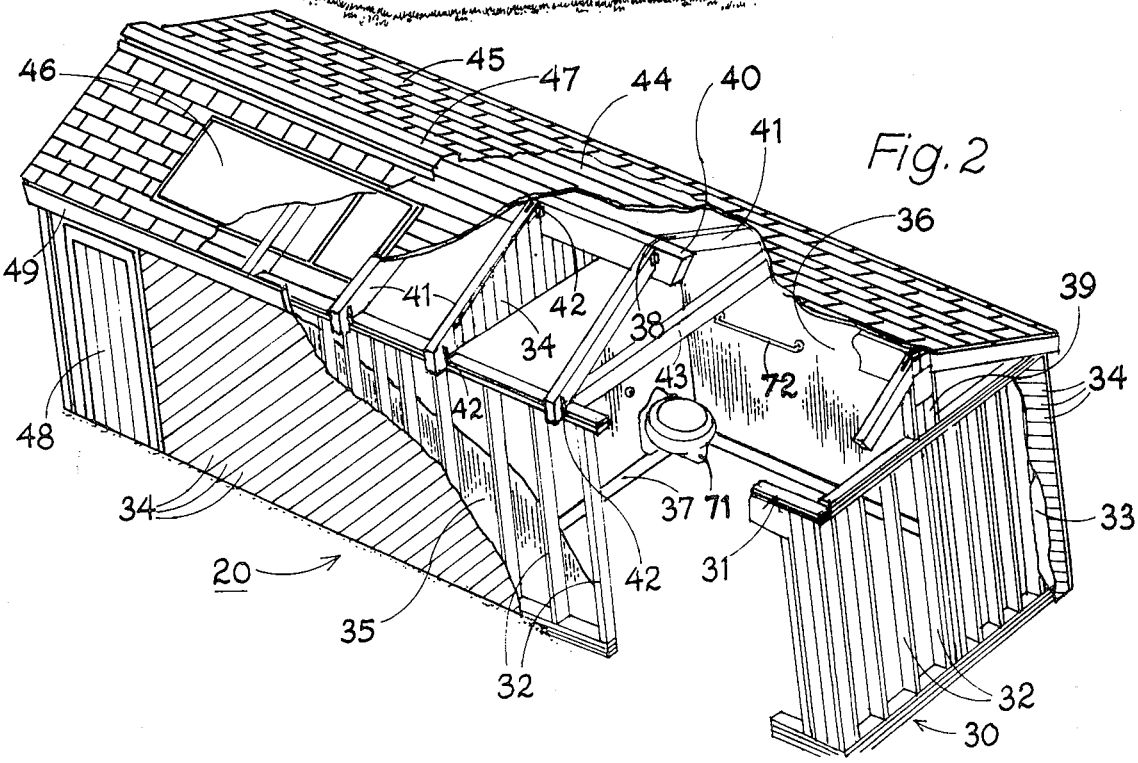
FIG. 2 is a perspective view, partially broken away and partially in cross-section of the pre-constructed, bottomless building of the present invention.

In FIG. 2, some of the construction details incorporated in prefabricated, preconstructed building 20 of the present invention are shown. Although the more unique aspects of the prefabricated, preconstructed building 20 of the present invention and the more unique methods of manufacturing building 20 of the present invention are detailed below, the following overview discussion will highlight these unique aspects, as well as other features incorporated into building 20, all of which combine to form a unique, synergistic construction. In order to impart the requisite strength and rigidity to prefabricated, preconstructed floorless building 20, base frame 30 comprises a triple sill plate, or triple thick, interconnected plate construction, as the bottom peripheral frame assembly of building 20. In addition, each wall member also incorporates an upper, double thick, interconnected frame 31 along the top of each wall member.

The frame assembly of the walls of building 20 is completed by vertical studs 32. Exteriorly building paper 33 is mounted to studs 32 with one inch by eight inch tongue and grooved exterior planking 34 mounted to building paper 33, studs 32 and frames 30 and 31.

Interiorly, plywood sheets or particle and resin boards 35 are mounted to studs 32 and frames 30 and 31 to form the interior walls. In addition, in the restroom areas themselves, where cleanliness is required, fiberglass wall panels 36 are mounted to plywood sheets or particle boards 35. In addition, the bathroom fixtures, such as water closets 71, grab bars 72, and partitions (not shown) are installed. When installed in position at the site, building 20 is completed by mounting a sanitary base 37 between fiberglass wall portion 36 and the floor-forming foundation (not shown).

Building 20 also incorporates a structural central ridge beam 40 which extends longitudinally the entire length of building 20, and is held in place by vertical support members 39 which are mounted perpendicularly to the upper frame 31 of each transversely extending wall member. Rafters 41 are secured near one of their ends to upper frame assembly 31 of the longitudinally extending wall members, and are secured to ridge beam 40 at their other ends. Steel straps 38 and steel plates 42 are mounted at the connection points of rafters 41 in order to assure securement of the rafters in position to ridge beam 40 and frame assembly 31.

The roof of building 20 is preferably formed by tongue and grooved decking 44 to which shingles 45 are mounted. In addition, building 20 also preferably incorporates a skylight 46 and vent means which, in the embodiment shown in FIG. 2, comprises a continuous ridge vent 47. Finally, doors 48 are also formed of tongue and grooved planking with the building being completed by molding strips 49.

In the preferred embodiment, all of the wooden frame members employed in constructing building 20 are pressure treated for protection against decay and insect attack with all exterior planks and sheets, roof girders, and roof decks being pressure treated and also receiving a separate fire-retardant treatment.

In the preferred construction, a preservative is applied to all lumber and plywood in conformance with the American Wood Preservation Association Standard P5. Injection of CCA dry salts in pounds per cubic foot (oxide basis) as scheduled in this section, should be assayed in accordance with AWPA Standard C-2.

The fire-retardant treatment which is preferably applied to all framing lumber, decking and sheathing shall be rated with a flame-spread of less than 25.

In addition, in the preferred construction of building 20, all joists, studs, plates, frame assemblies and rafters are glued and nailed at all connections, with all sheathing also glued and nailed to the plates and studs. In this way, structural rigidity of building 20 is provided and enhanced.

Modular Construction

By referring to FIGS. 3–9, along with the following detailed discussion, one embodiment for constructing the prefabricated, fully constructed building 20 of the present invention can best be understood. By employing the methods of this invention, a fully constructed, completely fabricated, structurally rigid building, having no floor members, is achieved in a manner which is economical while providing a building which is capable of being lifted and placed in position on a foundation formed at the site. One method for achieving this inherent structural rigidity, while also being capable of complete fabrication and construction at a reasonable cost, employs the use of preconstructed modularized wall panels.

Endwall Panels

Figure 3:
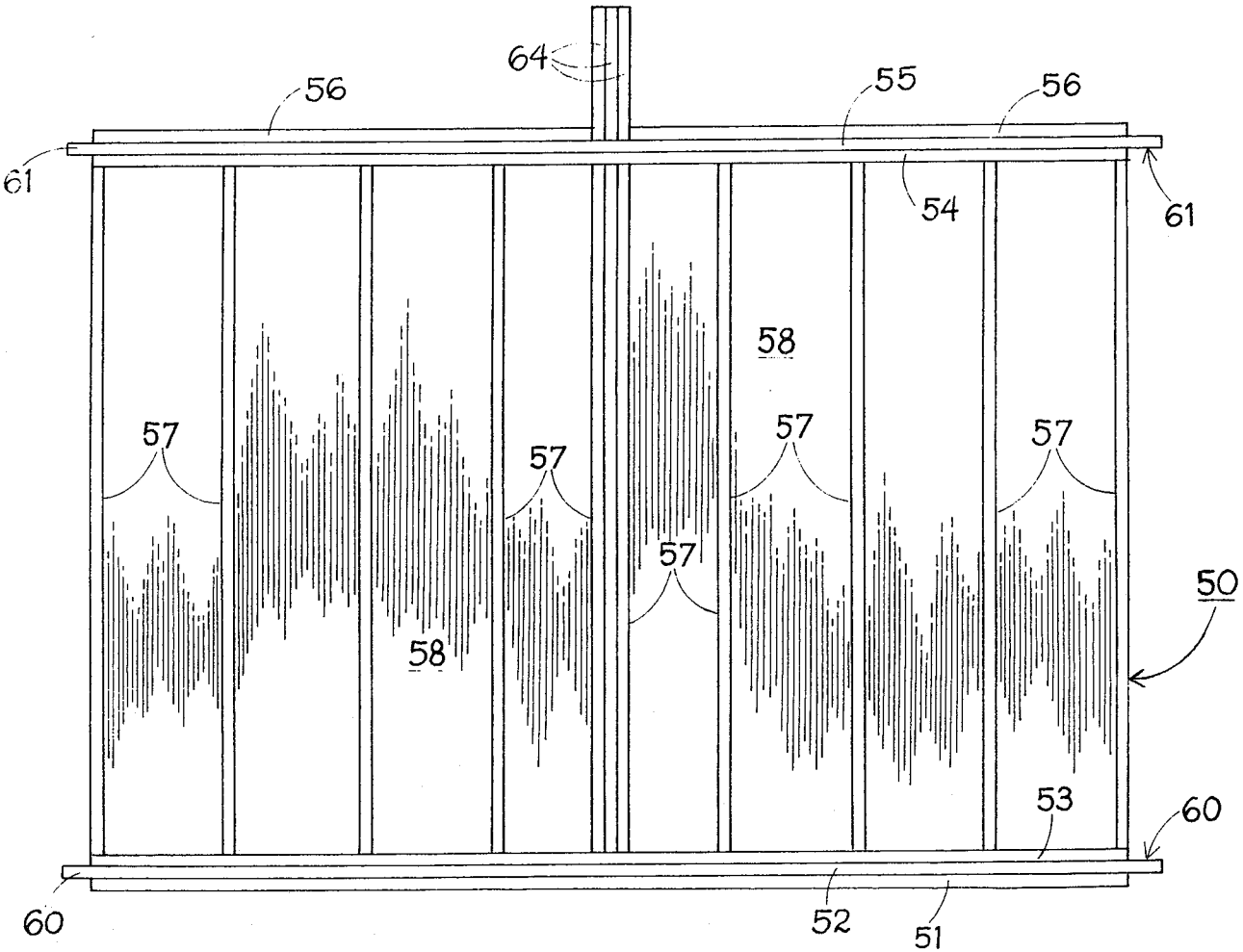
FIG. 3 is an elevation view of one embodiment for an endwall panel for use in the preconstruction of the building of the present invention.

As shown in FIG. 3, a typical outside endwall panel 50 is shown. Endwall panel 50 incorporates a base supporting frame comprising three elongated continuous plank members 51, 52, and 53. In the preferred embodiment, elongated, continuous planks 51, 52 and 53 comprise two inch by four inch wooden board members. The top of frame 50 incorporates a double plank construction incorporating planks 54 and 55. The basic frame construction is completed by vertical stud members 57 which extend between and are connected to at least elongated planks 53 and 54, but are preferably connected to the entire triple plate construction at the bottom, and both of the double late members at the top.

As shown in FIG. 3, elongated, continuous plank member 52 comprises an overall length which is greater than the length of adjacent plank members 51 and 53. As a result, plank member 52 incorporates, at both of its ends, a tenon-forming extension 60. Preferably, tenon 60 extends outwardly from the terminating ends of adjacent plank members 51 and 53 a distance equal to the typical width of the plank members.

Similarly, continuous, elongated plank member 55 comprises an overall length which is greater than the overall length of adjacent plank member 54, thereby forming a tenon extension 61 at both ends thereof. Tenon 61 extends beyond the terminating edges of plank member 54 a distance equal to the typical width of the plank members.

Preferably, endwall panel 50 also incorporates two plank members 56 and three vertical beam-supporting posts 64. Plank members 56 are secured to elongated plank member 55, with posts 64 sandwiched therebetween, thereby providing temporary support for posts 64. In addition, plank members 56 are used as nail-receiving boards which will be used for the securement of the lower edges of boards 34, as shown in FIG. 2.

The construction of endwall panel 50 is then preferably completed by securing plywood panels 58, or an equivalent, to studs 57 and frame forming plank members on the one surface thereof which will form an inside wall of the restroom. In addition, fiberglass sheets are securely mounted to plywood panels 58, thereby completing the requisite wall surface for that area of the restroom. The opposite surface of wall panel 50 is preferably left with the studs and plank members fully visible.

Figure 5:
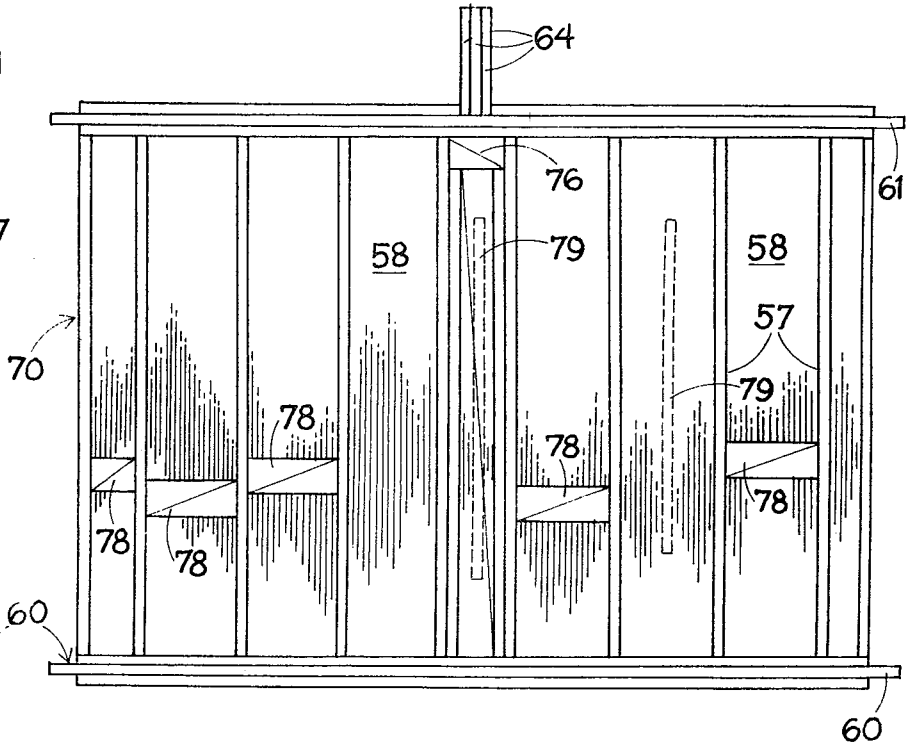
FIGS. 4 and 5 are elevation views of one embodiment of the interior wall panels used in the construction of the building of the present invention.
Figure 4:
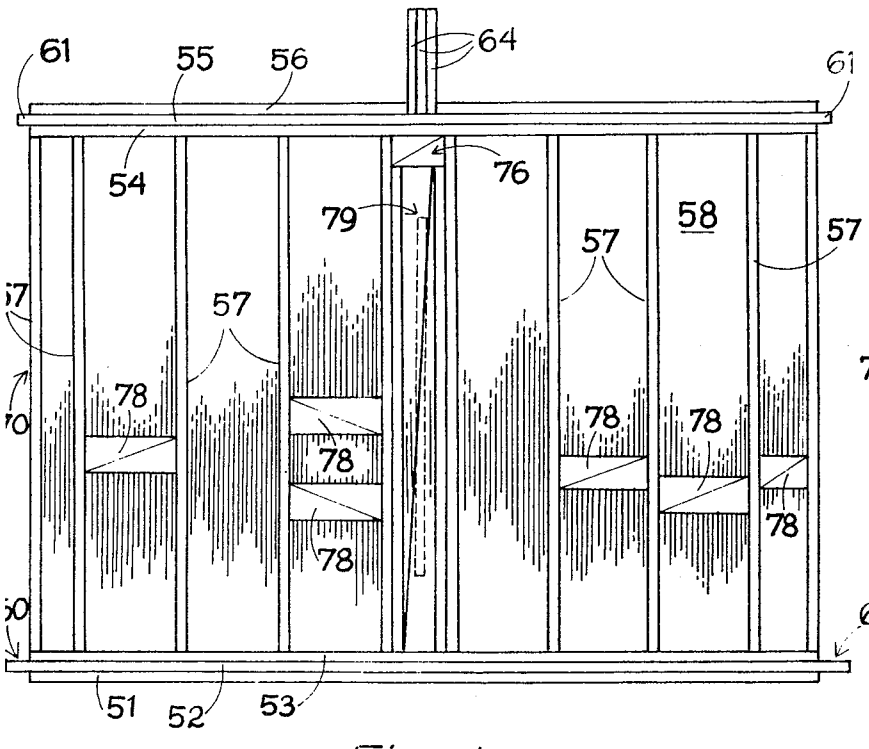

In FIGS. 4 and 5, interior wall panels 70 are shown, each comprising a substantially similar construction to endwall panel 50. In particular interior panel 70 incorporates a triple base construction comprising elongated, continuous planks 51, 52 and 53. The top of panel 70 incorporates a double plank construction comprising elongated planks 54 and 55.

In addition, interior wall panels 70 also incorporate tenon-forming extensions 60 at both ends of elongated continuous plank 52 and tenon-forming extensions 61, at both ends of elongated continuous plank member 55. As discussed above in reference to endwall panel 50, tenons 60 and 61 all extend from the terminating edge of their adjacent plank members a distance equal to the width of the plank members. In addition, panel 70 also incorporates, in the preferred embodiment, three beam supporting posts 64, preferably supportingly mounted between nail-receiving plank members 56.

Interior wall panel 70 also preferably incorporates plywood panels 58, or an equivalent, securely mounted to the surface thereof which will form an interior wall of the restroom. In addition, fiberglass panels are secured to the plywood panels to complete the wall surface treatment required in the restroom area. The opposite surface of wall panel 70 is preferably left with the studs and plank members fully visible in order to facilitate accessibility to the plumbing lines and electrical lines from the central utility room.

As shown in FIGS. 4 and 5 and described above, interior wall panel 70 is substantially identical in its construction to endwall panel module 50 of FIG. 3. The major difference between panels 50 and 70 is the spacing of the vertical studs 57 when securely mounted to the lower and upper plank members. As shown in FIG. 3, vertical studs 57 of panel 50 are all positioned substantially equidistant from each other, preferably at sixteen inches on center, with three stud members 57 being mounted in abutting engagement substantially about the central vertical axis of endwall panel 50. This triple vertical stud construction is employed to provide vertical supporting strength and rigidity for carrying the load incurred when the central support beam is installed in position.

In constructing interior wall panels 70, most of the studs 57 are positioned equidistant from each other, preferably at sixteen inches on center. However, in some instances studs 57 have a different spacing position in order to provide support for the restroom fixtures and partitions which will be mounted to interior wall panel 70, as well as provide additional inherent structural rigidity for building 20. As shown in FIGS. 4 and 5, a plurality of reinforcing blocks 78 are mounted to different pairs of juxtaposed spaced facing vertical studs 57, in order to provide the necessary support for securement of water closets, sinks, and other associated hardware required for the restroom facility. In addition, an elongated vertically disposed, T-shaped reinforcing member 79 is mounted to interior wall panel module 70, along with an interconnecting header 76. T-shaped reinforcing member 79 and header 76 are employed to provide vertical support for mounting of partitions to define the separate water closet areas of the restroom facility.

As shown in FIGS. 4 and 5, the two interior wall panels 70 are virtually identical in construction, with the only differences being in the positioning of the supporting blocks 78, reinforcing members 79 and headers 76. These variations are a direct result of the bathroom fixtures to be employed in the particular room and well-known differences between the fixtures used in male and female restrooms.

Figure 7:
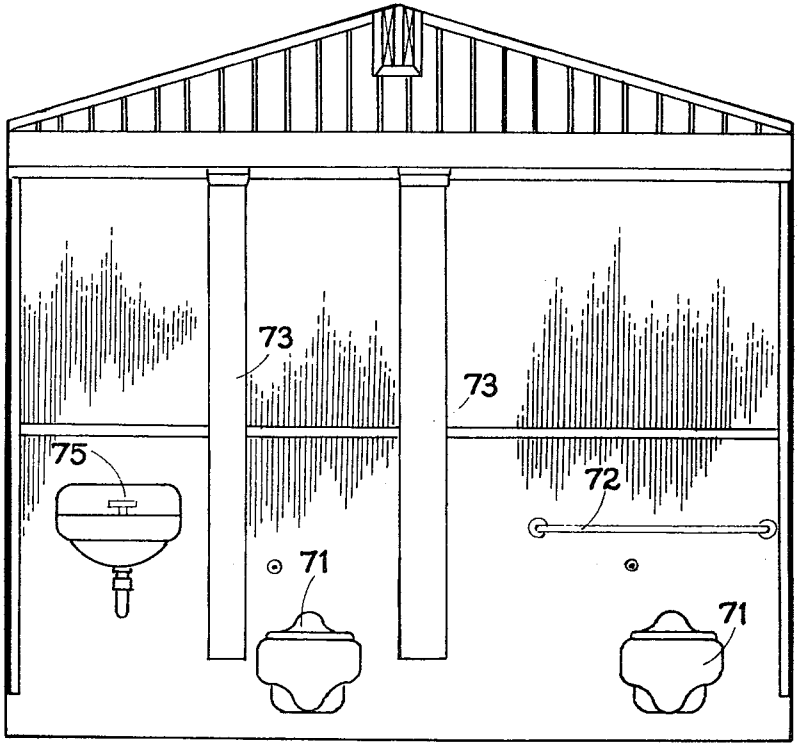
FIGS. 6 and 7 are elevation views of two fully completed interior walls of the building of the present invention with all of the bathroom fixtures shown mounted in place.
Figure 6:
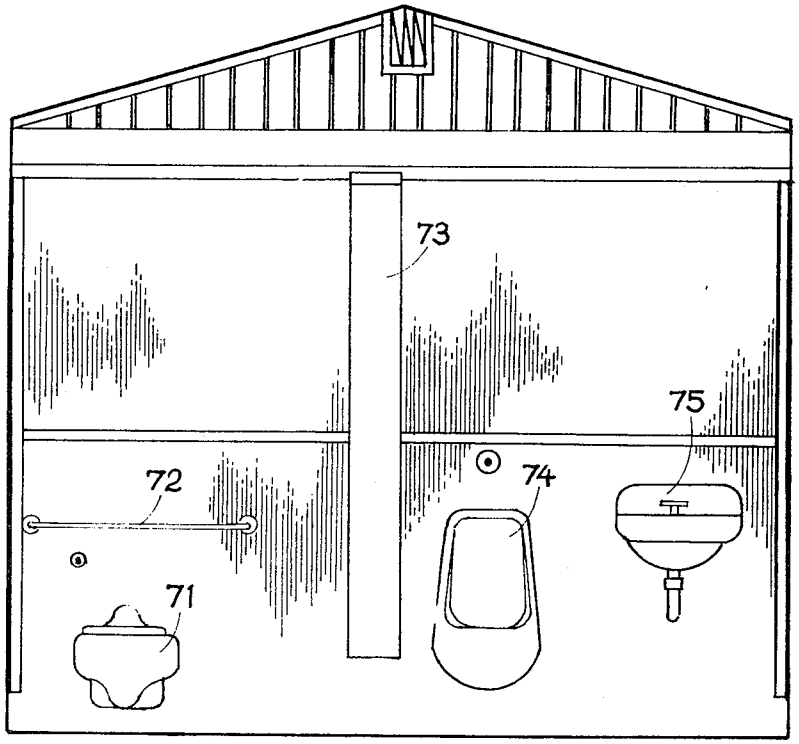

By comparing FIG. 4 with FIG. 6 and FIG. 5 with FIG. 7, the variations between the positioning of the supporting blocks and reinforcing members, as well as the manner in which the supporting blocks and reinforcements are employed becomes evident. In FIG. 6, the opposite side of wall panel 70 of FIG. 4 is shown after installation of all of the bathroom fixtures. The bathroom fixtures mounted to wall panel 70 comprise a water closet 71, with a handicap support bar 72 mounted above, a vertical partition 73, a urinal 74, and a sink 75. As shown in FIG. 4, which represents the view of wall panel 70 from the opposite direction, the positioning of the support means is self-evident. Similarly, in reviewing the bathroom fixtures mounted to the wall shown in FIG. 7, the positioning of the support blocks and reinforcing members detailed in FIG. 5 becomes evident.

It is also important to note that the construction detailed above allows all of the bathroom fixtures depicted in FIGS. 6 and 7 to be fully and completely supported on interior wall panel 70. As clearly shown in FIGS. 6 and 7, all of the bathroom fixtures are totally wall mounted and have no need for any floor support. As a result, the building of the present invention is capable of being constructed without any floor, cross beams, or supports upon which a floor is to be mounted.

Sidewall Panels

Figure 9:
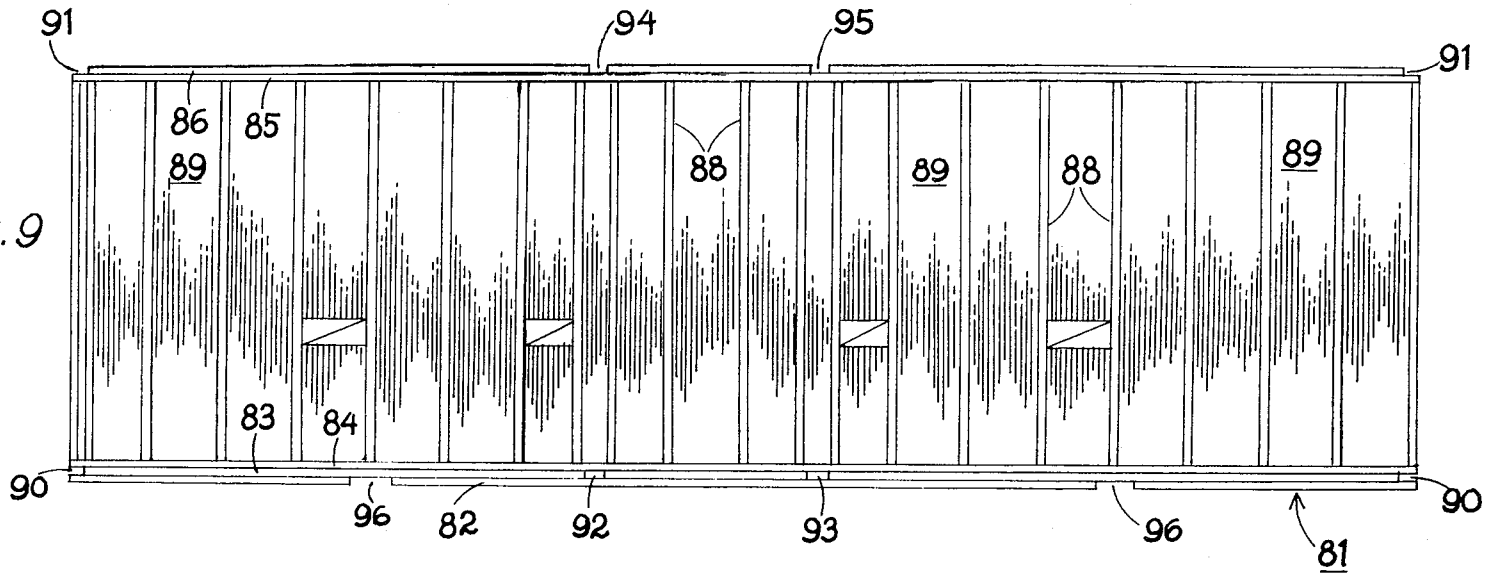
FIG. 9 is an elevation view of one embodiment of the rear wall panel for use in the preconstruction of the building of the present invention.
Figure 8:
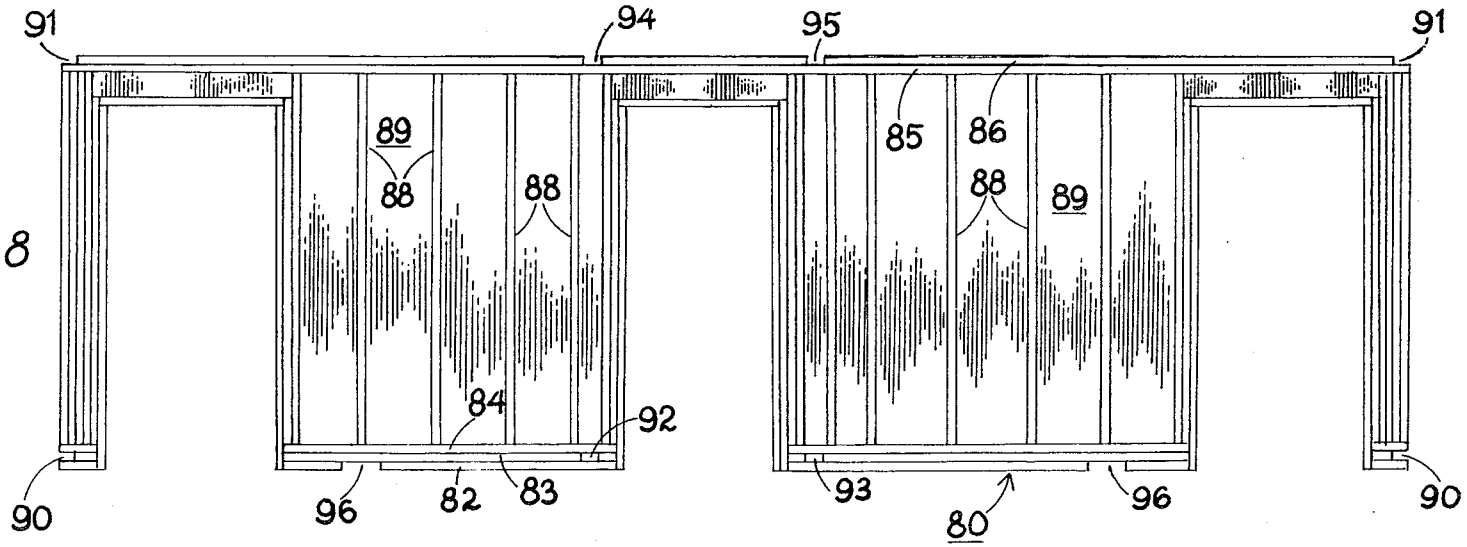
FIG. 8 is an elevation view of one embodiment of the front wall panel for use in the preconstruction of the building of the present invention.

In FIGS. 8 and 9, typical longitudinally extending sidewall panels 80 and 81 are shown. In FIG. 8, a typical front wall panel is depicted while FIG. 9 depicts a typical rear wall panel 81. Both panels 80 and 81 incorporate a triple sill plate construction comprising elongated planks 82, 83 and 84. The top edge of panels 80 and 81 incorporate a double plate construction comprising elongated, continuous plank members 85 and 86. Sidewall panels 80 and 81 are completed by a plurality of vertical studs 88 which are securely mounted at both of their opposed ends to upper and lower elongated plank members 82, 83, 84, 85, and 86.

The only difference between rear wall panel 81 and front wall panel 80 is the spacing employed between vertical studs 88. As shown in FIG. 9, rear wall panel 81 comprises the plurality of vertical studs 88 positioned substantially equidistant to each other along the entire length of wall panel 81. Preferably, studs 88 are positioned substantially sixteen inches on center, with the corners being reinforced with double or triple studs.

As discussed above in reference to endwall panels 50 and interior wall panels 70, sidewall panels 80 and 81 are also preferably constructed with plywood sheets 89, or in equivalent, securely mounted to the surface thereof which will form the interior walls of the building. In addition, fiberglass panels are also secured to those portions of the plywood panels 89 which will form the interior walls of the restrooms. The remaining plywood area will form the walls of the utility room and need not be covered with fiberglass sheets.

Sidewall panels 80 and 81 are both constructed with plank 83 thereof having an overall length which is less than adjacent elongated planks 82 and 84 at both ends of plank 83. As a result of this construction, a socket or mortise 90 is formed at both bottom ends of sidewall panels 80 and 81. Similarly, plank member 86 comprises an overall length which is less than adjacent plank member 95, at both ends thereof, thereby forming sockets or mortises 91 at both upper ends of sidewall panels 80 and 81. Mortises 90 and 91 all preferably comprise a width equal to the width of a single plank member.

In construction, mortises 90 and 91 receive the tenons extending from the endwall panels, thereby forming a secure, integrated, interconnection at the top and bottom of both ends of sidewall panels 80 and 81. As a result of this construction, the rigidity and strength necessary for achieving the self-supporting bottomless building of the present invention are further enhanced.

Sidewall panels 80 and 81 also incorporate sockets or mortises 92 and 93 formed in elongated plank 83 thereof and mortises 94 and 95 formed in elongated plank 86 thereof. Mortises 92 and 94 are aligned with each other to lie in substantially the same vertical plane, while mortises 93 and 95 are also aligned with each other to be in substantially the same vertical plane.

In construction, mortises 92 and 94 of sidewall panels 80 and 81 are employed for receiving tenons 60 and 61 extending from the bottom and top of interior wall panels 70. Similarly, mortises 93 and 95 of sidewall panels 80 and 81 receive tenons 60 and 61 extending from the second interior panel 70.

Sidewall frame modules 80 and 81 also incorporate lifting notches 96 which are formed in elongated plank member 82. Preferably, each sidewall frame module 80 and 81 incorporates two lifting notches 96, each of which are spaced inwardly from the side edge of the panel a distance equal to between about twenty to twenty-five percent of the overall length of the panel. In addition, each lifting notch 96 is preferably in juxtaposed spaced relationship below a stud 88 and centered about the central vertical axis of the stud aligned therewith. In this way, lifting notches 96 provide the support necessary to allow the entire building structure 20 to be lifted in its entirety for installation, as shown in FIG. 1.

By employing endwall panels 50, interior wall panels 70, and sidewall panels 80 and 81, as described and detailed above, a unique building system is achieved whereby a major portion of the entire building is prefabricated in modular units which are selected and secured together to obtain the desired sized structure. Using this invention, a plurality of endwall panels 50 and interior wall panels 70 may be constructed as described above, with a side to side width equivalent to the building width most often required. In constructing restroom structures, the buildings are typically about twelve-feet wide, regardless of the overall length of the structure. Consequently, a plurality of endwall panels and interior wall panels may be preconstructed in quantity with a twelve-foot frame width, ready for use when needed in a building.

Similarly, a plurality of sidewall panels 80 and 81 may be prefabricated in quantity of various lengths and various doorframe arrangements most commonly requested in the buildings. Then, when a building is to be completed, the properly sized preconstructed panels are selected and assembled.

By employing the prefabricated building system of this invention, preformed, preconstructed panels, which meet the requirements for the building to be constructed, would be selected and interconnected with each other to form a building of the desired size and shape. Preferably, one endwall panel would be first mounted to one of the sidewall panels by interconnecting the tenons of the endwall panel with the corresponding mortises of the sidewall panel. Each of these interconnections would be both nailed and glued.

Figure 10:
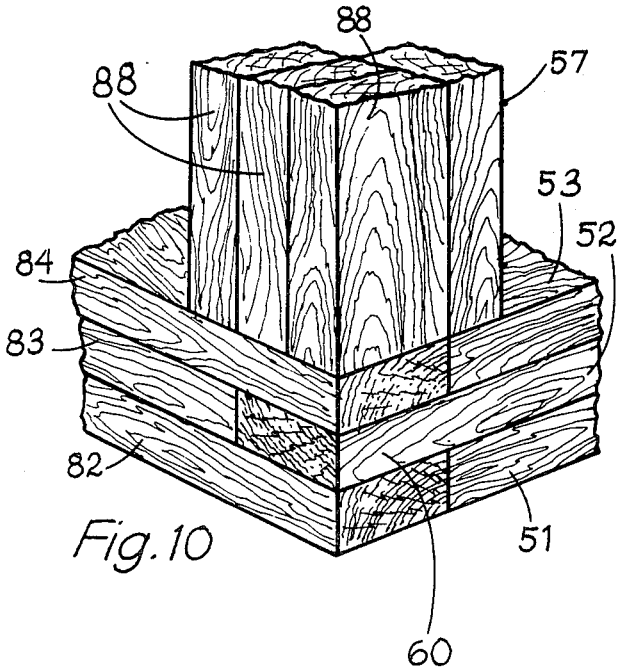
FIG. 10 is a detailed view, greatly enlarged, of a typical secure, interlocking connection between adjacent wall panels used in the preconstruction of the building of the present invention.

Then, the interior wall panels would be interconnected with the first sidewall panel by inserting and securely affixing the tenons of the interior wall panels with the mortises of the sidewall panel. Finally, the opposite sidewall panel would be mounted in place by positioning the tenons of the endwall panels and interior wall panels in position in the mortises of the sidewall panel. A typical mating interengaged mortise and tenon connection is shown in FIG. 10. Once all of these mounting points have been securely fastened to each other, the entire frame structure is completed, ready for the rafters, roof and fixtures to be mounted into position.

As discussed above, endwall panels 50, interior wall panels 70 and sidewall panels 80 and 81 are all preferably preconstructed as modular units incorporating the desired interior wall treatment. In particular, in the construction of restroom facilities where cleanliness and ease of maintaining cleanliness is of greatest importance, each of the wall frame modules are constructed with a one-quarter to one-half inch plywood, or fiber and resin board members, mounted to the frame structure. As with all previous interconnections, the plywood, or resin-fiberboard, are nailed and glued to the frame. Then, those areas which will form the interior walls of the restroom areas are fully surfaced with a high impact resistant fiberglass that is fire-resistant and resists cutting and marring.

Preferably, the fiberglass employed comprises a thickness of about 3/32" and is UL rated as being fire-resistant. Also, the sheet fiberglass is preferably glued to the plywood, or resin-fiberboard employing a suitable contact cement.

Alternative Construction Method

Figure 13:
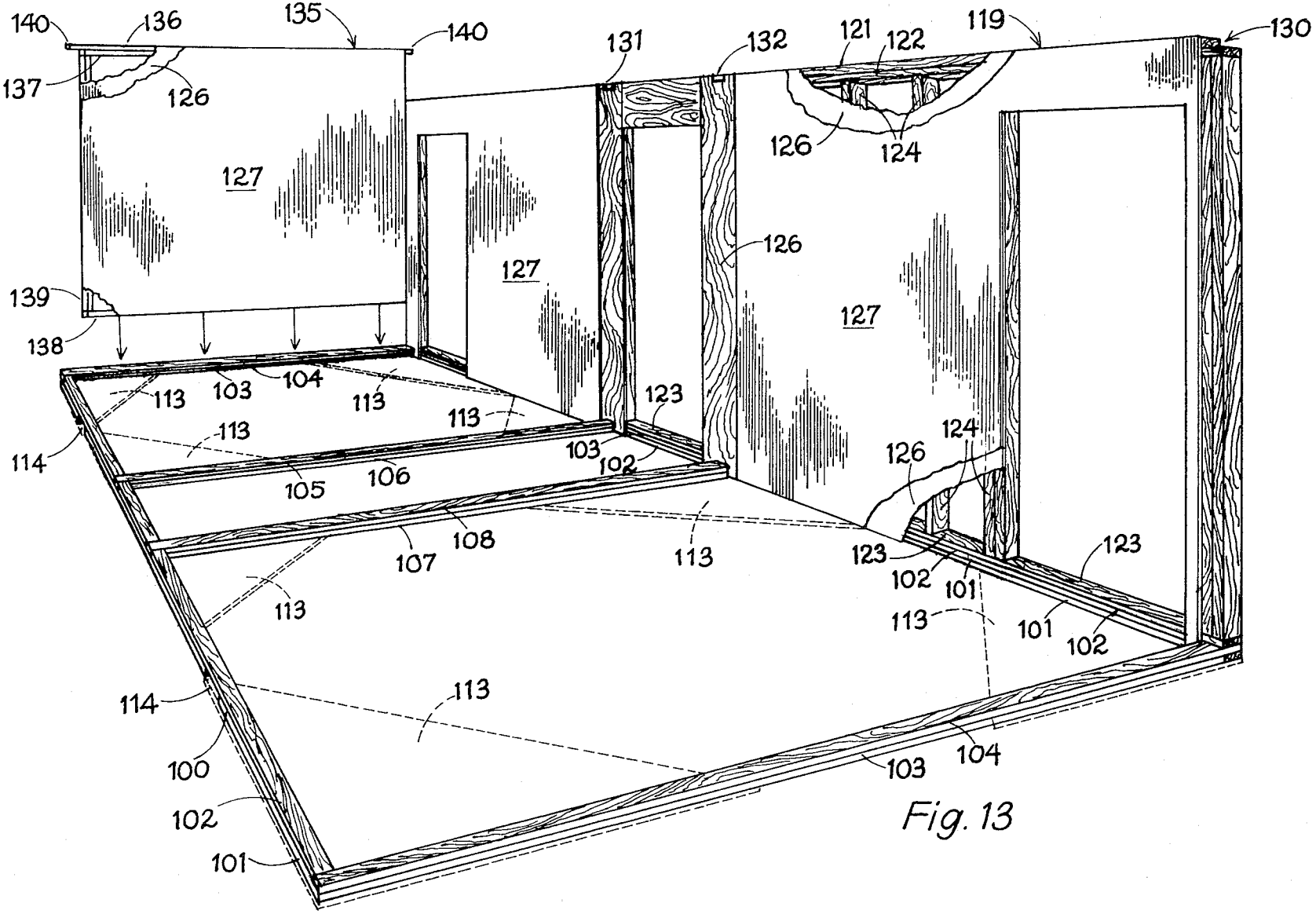
FIG. 13 is a perspective view showing an endwall panel being mounted to the base of FIG. 11 whereon the front wall panel has been previously installed.

In addition to the construction method detailed above, a second equally applicable and equally preferred construction method can best be understood by referring to FIGS. 11, 12 and 13, along with the following detailed discussion. By employing this method, an identical preconstructed building 20 is achieved having no floor and incorporating a triple plate base frame construction and a double plate frame construction about the top of the wall members, matingly interengaged as detailed above. In addition, preconstructed, prefabricated modular wall panels are also employed in this construction. However, some details of construction vary from the method described above and can be employed with equal efficacy, if so desired.

In this method, the construction of the desired size building is initiated by constructing a base frame assembly 100, best seen in FIGS. 11 and 13. Frame assembly 100 comprises a substantially rectangular shape, incorporating elongated plank members 101 and 102 defining the length of frame 100 and plank members 103 and 104 defining the width thereof. Plank members 101 and 102 are in abutting fixed mounted engagement with each other, while elongated continuous plank members 103 and 104 are similarly in mating engaged relationship with each other. Consequently, frame 100 comprises a double plank construction throughout its length and width.

In addition, frame assembly 100 incorporates transversely extending, continuous elongated planks 105 and 106 which extend perpendicularly between opposed plank members 101 and 102 on each side of frame assembly 100, while also being securely mounted in interlocked engagement therewith. Plank members 105 and 106 define the position and location for one interior wall member, while elongated transversely extending planks 107 and 108 define the position of the second interior wall panel.

In the preferred construction, all of the plank members are secured along their lengths and at each intersection employing both nails and glue. In this way, a double thick frame construction, which is inherently rigid, is provided.

In addition, in order to impart added rigidity to frame assembly 100 during construction, corner brackets 113 are employed at each right angle intersection. Although corner brackets 113 are not required in construction of frame assembly 100, their use is preferred in order to assure the desired perpendicularity of the frame members during construction. In this way, the perpendicularity of all of the walls is similarly assured and enhanced.

In constructing frame assembly 100, each elongated plank member 102 is preferably constructed with both of its opposed terminating ends cut shorter than adjacent elongated plank member 101, a distance substantially equal to the width of the plank members. Each continuous elongated plank member 104 is constructed with an overall length which is greater than adjacent interconnected plank member 103, thereby extending beyond the terminating edges of plank member 103 and filling the void area created by shortened plank member 102. As a result, plank members 102 and 104 are mounted in interlocked, tenon-mortise type fashion in order to provide secure mating engagement therebetween.

Similarly, each elongated plank member 102 is notched at juxtaposed, spaced, transversely aligned locations in order to receive elongated continuous transverse plank members 106 and 108 and allow plank members 106 and 108 to extend the complete maximum width of frame assembly 100, in a manner substantially identical to plank member 104. In this way, secure interlocked mounting engagement of plank members 105, 106, 107 and 108 with plank members 101 and 102 is provided.

Finally, each elongated plank member 101 of frame assembly 100 is notched at two locations along its length in order to form lifting notches 114 on both sides of frame assembly 100. Preferably, both lifting notches 114 are formed in each plank member 101 inwardly of both terminating edges of plank member 101 a distance of substantially equal to 20% to 25% of the overall width of plank member 101. In this way, lifting notches 114 are positioned in juxataposed spaced facing relationship on both sides of frame assembly 100 for optimum cooperative engagement with lifting means to lift the entire building 20 when complete.

Sidewall Panel Assembly

In FIG. 12, a typical sidewall panel 120 is shown in the process of being mounted to frame assembly 100. As shown therein, sidewall panel 120 incorporates a frame structure formed by elongated continuous top plank members 121 and 122, a single elongated continuous bottom plank member 123, and a plurality of vertical stud members 124. Vertical stud members 124 are securely mounted to elongated continuous plank members 121, 122 and 123 and positioned therealong, typically sixteen inches on center. Of course, where extra support is required, stud members 124 are positioned in closer proximity to each other.

In addition, reinforcing blocks 125 are mounted between vertical studs 124 at various locations where mounting reinforcements are required for the wall mounting of interior hardware. The construction of sidewall panel 120 is completed by mounting plywood panels 126, or equivalent, to the plank frame. In addition, as shown in FIG. 13, fiberglass sheets 127 are securely affixed to plywood wall 126 along the major portion thereof, in those areas which will form the restroom walls. The area which will be the utility room is left with plywood facing.

In order to achieve a building construction wherein minimum effort is required at the actual site of installation, the sidewall panels incorporate plywood 126 extending below elongated plank member 123 a distance substantially equal to the thickness of plank members 101 and 102 of frame assembly 100. In this way, as shown in FIG. 13, when the sidewall panel is securely mounted to frame assembly 100, the resulting interior wall extends completely to the bottom of frame assembly 100.

Although plywood panels 126 are depicted in FIGS. 12 and 13 and are described herein for forming the interior walls, substitute materials can be employed without departing from the scope of this invention. In particular, resin and fiber based sheets can be successfully employed in the present invention as an equivalent substitute for plywood sheet 126. Such boards would be installed in a substantially identical manner and would have fiberglass sheets 127 affixed thereto, in those areas where fiberglass sheets are required.

In addition as shown in FIG. 13, plywood sheets 126 and overlying fiberglass sheet 127 do not extend completely to the edge of the sidewall panel. Instead, plywood sheets 126 and fiberglass sheets 127 terminate substantially along the vertical plane defined by the interior side surfaces of plank members 103 and 104. In this way, as will be more fully understood from the discussion below, the endwall panel can be secured in place without dimensional interference from the thickness of plywood sheets 126 and fiberglass sheets 127.

As shown in FIG. 12, sidewall panel 120 incorporates notches 128 along the lower edge of plywood walls 126. In those areas where plywood walls 126 have been covered by fiberglass sheet 127, the fiberglass sheet is also similarly notched in order to assure a complete open zone 128.

In the preferred construction, plank member 121 incorporates an overall length which is less than the overall length of adjacent, interconnected plank member 122, at both opposed terminating ends of plank member 121. In this way, notches or mortises 130 are formed at both ends of plank member 121. In addition, plank member 121 also incorporates two additional notches or mortises 131 and 132 formed along the length thereof. In addition to plank member 121, plywood 126 and fiberglass panel 127, where necessary, are also notched to assure complete open mortise zones 131 and 132 exist in wall panel 120 as well as open mortises 130 at both top ends thereof.

As is readily apparent from a review of FIG. 12, mortise 132 is vertically aligned with a notch 128 and plank member 108. Similarly, mortise 131 is aligned with a notch 128 and plank member 106. As is more fully discussed below, notches 128 cooperatingly engage with plank members 106 and 108 while mortise 131 and plank member 106 provide the positioning for one interior wall panel. Similarly, mortise 132 and plank member 108 provide the positioning for the second interior wall panel.

Once sidewall panel 120 has been fully preconstructed, panel 120 is ready for mounted interconnection with frame assembly 100. As shown in FIG. 12, assembly of wall panel 120 with frame assembly 100 is completed by merely positioning sidewall panel member 120 along the elongated length of frame assembly 100, with continuous elongated plank member 123 being placed in overlying engagement with plank member 102. Once in position, plank member 123 and plank members 101 and 102 are secured together with both nails and glue.

As shown in FIG. 13, once a sidewall panel has been securely mounted in place, planks 123, 101 and 102 form the triple sill plate base frame along the entire length thereof. In this way, the same triple plate structure detailed above is attained.

Since notches 128 are formed in all areas where overlying interconnected engagement is required, preconstructed panel 120 is quickly and easily securely mounted to frame assembly 100 without requiring any further modifications or alterations. Once placed in the desired position, all that is required is a secure interconnection of elongated plank member 123 with plank members 101 and 102. Once sidewall panel 120 has been securely mounted to frame assembly 100, the next step in the construction process is to secure an end wall panel to frame assembly 100.

Before describing the construction operation for securely mounting an end wall module to frame assembly 100, it is important to note that in FIG. 12, sidewall panel assembly 120 is depicted as a typical continuous sidewall panel having no doorways. For purposes of illustration and discussion, and to clearly show an illustration of both alternative sidewall panels 119 and 120, FIG. 13 depicts the opposed sidewall panel module 119, wherein the necessary doorways have been incorporated. It is readily apparent that the building construction depicted in FIG. 13 does not directly follow the construction depicted in FIG. 12, wherein sidewall module 120 is shown being installed to frame assembly 100 before any other panel.

Endwall Panel Assembly

By referring to FIG. 13, the construction and installation of endwall panel 135 can best be understood. In a manner substantially similar to the constructions described above, endwall panel 135 incorporates two continuous, elongated upper plank members 136 and 137 and a single elongated continuous lower plank member 138, to which vertical stud members 139 are securely mounted.

In addition, elongated plank member 136 comprises an overall length which is greater than the overall length of adjacent interconnected plank member 137. These additional lengths at both ends of plank member 136 form tenon portions 140 at both ends thereof. Tenons 140 extend beyond the length of adjacent interconnected plank member 137, at both ends thereof, a distance substantially equivalent to the width of the plank members.

Once this frame has been completely assembled and securely interconnected with both nails and glue, endwall panel 135 is completed by first mounting plywood sheets 126 to the frame assembly and then securely mounting fiberglass sheets 127 to plywood 126. The securing method for both the plywood and fiberglass is substantially identical to that described above. Similarly as described above, fiber and resin boards can be substituted for plywood 126.

In addition, plywood 126 and fiberglass 127 both extend along the lower edge thereof beyond the lower terminating surface of elongated plank member 138 a distance substantially equal to the thickness of plank members 103 and 104. As described in detail above, in reference to the sidewall panels, this extension of plywood 126 and fiberglass 127 allows the fiberglass and plywood to be securely mounted to the interior side surface of plank members 103 and 104, thereby covering the plank members and providing an interior wall portion which extends completely to the bottom of the building structure, when installed at the site.

Once endwall panel 135 has been completely prefabricated, endwall panel 135 is quickly and easily installed in position and secured to sidewall panel 119 and frame assembly 100. This installation is achieved by placing endwall panel 135 in position and lowering endwall panel 135 onto frame assembly 100 with bottom plank member 138 coming into abutting contact with elongated plank member 104.

Simultaneously, a tenon 140 on one side thereof comes into engagement with mortise 130 of sidewall panel 119. Once in position, plank member 138 is securely mounted to planks 103 and 104 while tenon 140 is securely mounted to the plank members forming mortise 130. Once these mounting interconnections are completed, endwall panel 135 is securely mounted in place ready for the next step in the construction process.

The next steps in completing the construction of the desired building is to securely mount the remaining interior wall panels and exterior wall panels in position, interconnecting these panels where so required. Although the remaining wall panels can be installed in virtually any desired order, it has been found to be most efficient to first position the two interior wall panels in their desired location, without securely mounting the interior wall panels in place. Then, the remaining endwall panel is placed in the desired position and temporarily held in that position, without final securement.

Once all of the interior wall panels and the remaining endwall panel have been temporarily placed in their desired positions, the remaining sidewall panel is positioned in cooperative engagement with frame assembly 100 and securely mounted thereto. Once the remaining sidewall panel is secured to frame assembly 100, the interior wall panels and the second endwall panel are all securely mounted to frame assembly 100 as well as the sidewall panels where the tenons of the endwall and interior wall panels interengage with the mortises of the sidewall panels.

If desired, nail-receiving, post-supporting elongated plank members may be affixed along the top of each endwall panel and each interior wall panel at this time. In addition, vertical beam supporting posts may also be installed at this time. Once this step is completed, the walls of the structure are completed, and ready for the building's finishing steps.

Construction Completion Details

Regardless of the method employed to erect all of the wall frame assemblies, the remaining building completion construction details are substantially identical. In addition, except for specific construction methods which will be specifically detailed below, most of the remaining steps to complete building 20 of the present invention comprise generally known and accepted carpentry steps employed in any quality carpentry work.

By referring to FIG. 2 and the following description, these completion details can best be understood. The first step, if not previously accomplished, is to install beam support posts 39 along with its associated supporting nail-receiving plank members to the double top plate of the endwall panels and interior wall panels. Then central ridge beam 40 is securely mounted to support posts 39. Once completed, rafters 41 are secured to central beam 40 and the upper triple plate frame structure 31 formed by the interconnection of the wall panels.

In the preferred embodiment, roof rafters 41 are all cut or notched, as required, in order to securely engage with central beam 40 and upper double plate frame 31, while still maintaining a uniform level sloping angle throughout. In addition, rafters 41 are mounted with galvanized steel interconnection plates 42 being employed at each connection point. Also, galvanized steel rafter straps 38 are employed to assure the secure mounted engagement of rafters 41 and beam 40.

The next step in the completion of building 20 is the mounting of tongue and groove plank members 34 to rafters 41 and the top edge of the endwall panels and the interior wall panels. The interior wall construction is then fully completed by installing angled and flat stainless steel plates at all corners where the fiberglass sheets intersect, as well as along the wall surfaces where two sheets of fiberglass are in abutting contact.

In the preferred embodiment, the stainless steel flat plates and angle plates are all installed using screw means and adhesive bonding tape. In this way, any vandalism that might be caused by the removal of the screw means holding the plates will be thwarted, since the bonding tape will prevent the easy removal of these stainless steel plates.

The preferable next step in the construction process is to complete the mounting and installation of all of the bathroom fixtures and the installation of the electrical system. In order to completely install all necessary plumbing lines, cold water piping, soil, waste, and vent piping, as well as all plumbing fixtures, drains, traps, valves and clean-outs must be installed. Included in this installation step are all of the water closets, urinals, partitions, and sinks or lavatories, along with fully installed faucet assemblies. Preferably, all piping is installed with proper pitch angles so that valves may be drained in order to protect them from freezing. Also, valves are all placed to permit ready access for examination and operation.

The installation of a complete electrical system includes installation of service switches, metering equipment, panelboards, lighting fixtures, receptacles and all conduits and wiring needed. In addition, necessary grounding cables are also installed.

Once the plumbing and electrical systems have been fully installed, the next step in the completion process is the installation of roof decking 44 to rafters 41 which is followed by the installation of roof 45 and skylights 46. In addition, all flashing is installed at this time in order to assure a water-tight room and skylight.

Preferably, once roof decking 44 has been fully installed, felt roofing paper is first installed in order to provide an underlaying for the preferred fiberglass shingles. The roof underlayer is preferably fifteen pound asphalt impregnated roofing felt and the fiberglass shingles are preferably three hundred pound class A fire rated fiberglass self sealing type shingles. Galvanized steel is then employed as edge strips and soft temper copper is preferably employed for the water-tight flashing installations.

The installation of skylights, although optional, is preferred in order to provide natural light in the restroom areas. In order to provide a vandal resistant structure, the skylight preferably employs an acrylic monomer sheet, such as Lexan, manufactured by the General Electric Company.

In addition, the exterior surface of the building is preferably completed at this time. This is achieved by first installing the fifteen-pound building paper 33 to all of the exterior wall frames and then securely affixing the tongue-and-groove exterior planks 34 to the exterior frames.

Finally, doors 48 and trim 49 are installed, completing the prefabricated, preconstructed building 20, which can now be transported and installed at the desired location. If desired, door members 48 can be installed at the site after building 20 has been lifted and set in position. However, it has been found that the installation of door members 48 prior to transportation is preferred and reduces the time and effort required at the site of the building's installation.

If door members 48 are securely mounted in position prior to transportation, the triple sill plate extending along the lower edge of each door entry zone must be cut in order to allow the door to be set securely in its operating position. As a result, some of the inherent structural rigidity of building 20 is eliminated.

Consequently, if door members 48 are installed prior to transportation, door bracing means must also be installed prior to transportation, in order to provide the necessary strength and rigidity needed for assuring that the peripherally surrounding triple sill plate frame structure will be capable of supporting the building loads when lifted and moved into position at the site.

Figure 14:
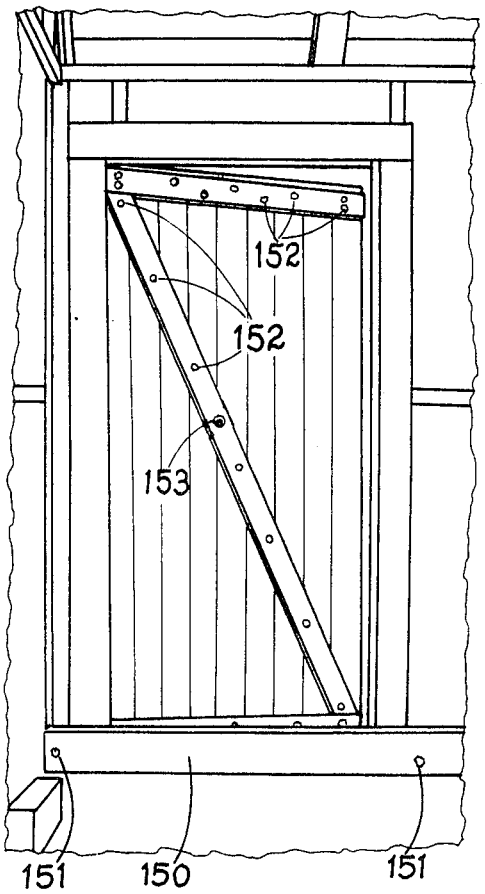
FIG. 14 is an elevation view, partially broken away showing a doorway and the reinforcing means preferably used therein for transportation.

In FIG. 14, the preferred doorway bracing means are shown. In general, doorway bracing means comprise an elongated plank member 150 which is secured along the bottom edge of the doorway by employing bolt means 151. Bolt means 151 are preferably driven directly into the triple sill plate construction, although installation into the studs is also acceptable. If desired, a brace means may be installed in the doorway for added strength and rigidity. Preferably, plank member 150 comprises a two inch by six inch plank or larger member, in order to provide the desired structural rigidity.

Although the installation of bracing member 150 and bolt means 151 requires additional steps which must be reversed at the site for removal of the bolt means 151 and bracing plank 150, it has been found that the installation of the doorway is most advantageously accomplished prior to transportation. As a result, once a building has been set in place, the installer need only quickly and easily remove bolt means 151, thereby freeing reinforcing plank member 150 for removal. In this way, site installation is achieved rapidly, without complicated instructions.

In addition, each door is preferably constructed to be vandal resistant. In order to achieve this result, the door is made from tongue and groove plank members which are secured in the conventional manner and then reinforced by a "Z" brace which is bolted to the plank members, as shown in FIG. 14. Preferably, carriage bolts 153 are employed, with their smooth, rounded head being positioned on the outside of the door. Holes are drilled in the "Z" brace at a plurality of locations therealong in order to enable bolts 153 to be countersunk. Once installed, the holes are filled with wood putty 152, thereby preventing bolts 153 from being easily vandalized.

Figure 16:
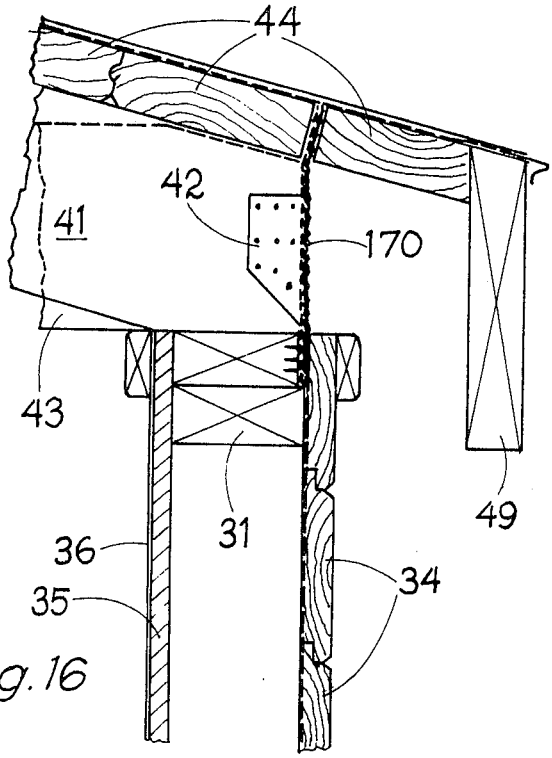
FIG. 16 is a cross-sectional elevation view, partially broken away, showing a venting mesh screen locked in place along a side wall.

In FIG. 16, an alternate method for securely affixing vent means in a vandal-resistant manner is shown. In this embodiment, metal wire mesh screen portions 170 are installed along one side of building 20 between rafters 41. Preferably, wire mesh screen 170 comprises 20 gauge hot dipped galvanized expanded metal vent material. In order to achieve a vandal-resistant construction, wire mesh screen portions 170 are secured along their upper elongated edges between adjacent roof planks 44. In addition, their lower elongated edges are each secured to top frame 31 and then sandwiched between top frame 31 and exterior planking 34. As a result of this construction, vent screens 170 can not be easily torn away.

Once building 20 has been completed, building 20 is ready for being transported to the desired site, lifted from the transportation means by straps 24 of crane 21 and placed on a foundation 23, previously constructed for receiving building 20, as shown in FIG. 1. Since the prefabricated, preconstructed building 20 of the present invention, as described and detailed above, has a weight which typically ranges between five and twenty-five tons, the ability for building 20, with no floor joists or floor members for support, to be raised, as shown in FIG. 1, from a truck or other transportation means, completely lifted and moved into position and then placed on a foundation clearly provides a unique construction system previously unknown and unobtainable in prior art systems.

Once building 20 has been lifted from the transportation means and positioned on the concrete foundation 23, only a few final completion steps need be executed before the building is ready for full operation. Of course, the plumbing connections and the electrical connections must be made between the prefabricated building 20 and the associated, corresponding drains, pipes, etc., all of which are formed in foundation 23. Then, interior base molding 37, shown in FIG. 2, is installed about the entire periphery of each of the restrooms between the fiberglass wall and the concrete floor.

Externally, building 20 is secured to foundation 23 using either one of two procedures. One such procedure can best be understood by referring to FIG. 1, wherein a plurality of upstanding connection plates 29 are shown.

Preferably, each upstanding plate 29 incorporates a through hole formed therein through which bolt means are inserted and interengaged with the lower edge of building 20, once building 20 has been placed on foundation 23. With the insertion of bolt means through each upstanding plate 29 into direct engagement with building 20, building 20 is secured in its position on foundation 23.

Although FIG. 1 depicts plates 29 along only one side of building 20, the preferred embodiment employs plates 29 peripherally surrounding building 20 for interengagement with all outside walls of building 20. In this way, building 20 is securely affixed to foundation 23.

Figure 15:
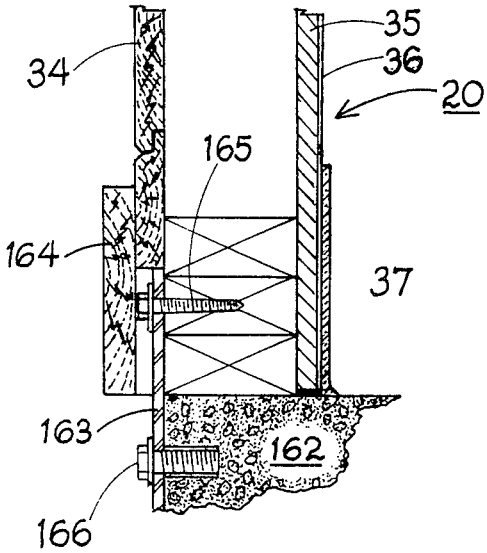
FIG. 15 is a cross-sectional elevation view, partially broken away, showing one embodiment for securing the building to the foundation.

The alternative method employed to secure building 20 to its foundation can best be understood by referring to FIG. 15. In this embodiment, foundation 162 is formed having an overall length and width which substantially corresponds to the overall length and width of the prefabricated building 20 to be positioned thereon. In this embodiment after building 20 is in position, a plurality of anchor plates 163 are mounted peripherally about building 20 to secure prefabricated building 20 to foundation 162.

In the preferred construction, anchor plates 163 comprise an overall length of about four inches and a width of about one inch, and incorporate two through holes. Each anchor plate 163 is positioned with one through hole in abutting contact with the triple sill plate of building 20 through, which bolt means 165 is positioned and securely mounted. The other through hole is positioned in abutting contact with foundation 162, through which concrete, lag bolt means and expansion means 166 are passed to securely engage anchor plate 163 to foundation 162. Once bolt means 165 and 166 have been installed about the entire outer periphery of building 20, building 20 is secured to foundation 162.

Although either securement method may be employed, the use of flanges 29 embedded in foundation 23 during the initial pouring of the foundation is preferred. The use of anchor plates 163 require concrete to be poured a second time, after building 20 has been secured in place, in order to form the sidewalk area and the area peripherally surrounding building 20. With the use of upstanding flanges 29, all of the concrete can be poured in one step, thereby eliminating the need for a second concrete pour.

The installation of building 20 is fully completed by removing all brackets and reinforcing members employed for transportation and then placing molding 164 about the entire outer peripheral surface of building 20 along the lower edge thereof. The positioning of typical molding 164 is shown in FIG. 15. However, prior to the installation of molding 164, a block member dimensioned for insertion in the lifting notches of building 20 is perferably installed in order to fill this otherwise completely open area. After the installation of blocks in the four lifting notches about building 20, base molding 164 is installed, thereby completing the installation of prefabricated, preconstructed building 20 of the present invention. By employing the teaching of this invention, a prefabricated, rugged, low-cost, vandal resistant building 20 is achieved which is quickly and easily transported, placed on the site, and is fully installed ready for use quickly and easily.

It will thus be seen that the objects set forth, among those made apparent from the preceding description, are efficiently attained and, since certain changes may be made in carrying out the above method and in the construction set forth without departing from the scope of the this invention, it is intended that all matter contained in the above description as shown in the accompanying shall be interpreted as illustrative and not in a limiting sense.

It is also to be understood that the following claims are intended to cover all of the generic and specific features of the invention herein described, and all statements of the scope of the invention, which as a matter of language, might be said to fall therebetween.

Having described my invention, what I claim as new and desire to secure by Letters Patent is:

1. A method for constructing a floorless pre-assembled, relocatable building in an off-site factory which is capable of being transported to a building site, raised from the transportation means and lowered into position on a substantially level, monolithic concrete foundation slab, said method comprising the steps of:

A. constructing a first, self-supporting, wall member comprising a fully interconnected, unitized, assembly formed from a plurality of stud-interconnected, securely joined plank members, all of which are interconnected by rigidifying sheathing, and having a length equal to the entire, overall, outside dimension of one side of the building, said first wall member being constructed by 1. forming a bottom frame portion by nailing and gluing three rows of elongated plank members in stacked, secure, mounted abutting engagement with each other, the middle row of elongated plank members comprising an overall length greater than the overall length of the adjacent two rows of plank members, thereby forming tenons at each end of said bottom frame portion,
2. nailing and gluing a plurality of stud-forming plank members at their terminating ends to the plank members forming the top row of the bottom frame portion, with said stud-forming plank members being positioned substantially perpendicularly to the elongated bottom frame portion, 3. forming a top frame portion by nailing and gluing two rows of elongated plank members in stacked, securely mounted abutting engagement along substantially their entire length, with the top row of the elongated plank members having an overall length greater than the overall length of the adjacent underlying row of plank members, thereby forming tenons at each end of said top frame portion,
4. nailing and gluing the opposed terminating end of the plank members extending perpendicularly from the bottom frame portion to the plank member forming the lower row of the top frame portion; and
5. nailing and gluing sheathing material to at least one side of the stud-forming plank members forming the wall member, with the top portion of the sheathing material substantially covering the two rows of plank members forming the top frame portion and with the bottom portion of the sheathing material substantially covering the entire three rows of plank members forming the bottom frame portion;

B. constructing a second, self-supporting wall member comprising a fully interconnected, unitized, assembly formed from a plurality of interconnected, securely joined plank members, all of which are interconnected by rigidifying sheathing and having a length equal to the entire, overall, outside dimension of one side of the building, the second wall member being constructed by
1. forming a bottom frame portion by nailing and gluing three rows of elongated plank members in stacked, secure, mounted abutting engagement with each other, the middle row of the elongated plank members comprising an overall length less than the overall length of the adjacent two rows of plank members, thereby forming mortise zones at each end of said bottom frame portion,
2. nailing and gluing a plurality of stud-forming plank members at their terminating ends to be plank members forming the top row of the bottom frame portion, with said stud-forming plank members being positioned substantially perpendicularly to the elongated bottom frame portion,
3. forming an top frame portion by nailing and gluing two rows of elongated plank members in stacked, securely mounted abutting engagement along substantially their entire length, with the top row of elongated plank members comprising an overall length less than the overall length of the adjacent underlying rows of plank members, thereby forming mortise zones at each end of said top frame portion,
4. nailing and gluing the opposed terminating ends of the stud-forming plank members extending perpendicularly from the bottom frame portion to the plank members forming the lower row of the top frame portion portion, and
5. nailing and gluing sheathing material to the plank members forming a wall member, with the top portion of the sheathing material substantially covering the two rows of plank members forming the top frame portion and the bottom portion of the sheathing material substantially covering the entire three rows of plank members from the bottom frame portion;

C. securely interconnectedly affixing two of the tenons along one side of the first wall member to two of the mortises along one side of the second wall member by nailing and gluing said tenons in said mortises;
D. constructing a third wall member substantially identically to the first wall member;
E. constructing a fourth wall member substantially identically to the second wall member;
F. interconnecting and securely affixing said third wall and said fourth wall member to the interconnected, first and second wall members by nailing and gluing the mating tenons and mortises thereof;
G. securely affixing a roof means to the top plank row of the top frame portion, thereby obtaining a floorless, pre-assembled, relocatable building constructed in an off-site factory, ready for being transported to a building site, raised from the transportation means, and lowered into position on a concrete, substantially level, monolithic foundation and slab, without causing any degradation to the building structure.

2. The method defined in claim 1, comprising the additional steps of
H. forming a substantially level, monolithic, concrete foundation slab in a particular location where the floorless, pre-assembled, relocatable building is desired;
I. transporting the floorless, pre-assembled, relocatable building from the off-site factory to the site of the building location;
J. lifting the building in its entirety from the transportation means;
K. lowering the building in position onto the preconstructed, substantially level, monolithic, concrete foundation slab; and
L. bolting the building in position to the concrete foundation slab.

3. The method for constructing a floorless, pre-assembled, relocatable building in an off-site factory as defined in claim 1, wherein the method comprises the additional steps of:
H. constructing a self-supporting, interior wall member comprising a fully interconnected, unitized, laminated assembly formed from a plurality of interconnected, securely joined plank members, all of which are interconnected by rigidifying sheathing and having a length substantially equal to the entire, overall, interior dimension of one side of the building, said interior wall member being constructed by
1. forming a bottom frame portion by nailing and gluing three rows of elongated plank members in stacked, secure, mounted abutting engagement with each other, the middle row of elongated plank members comprising an overall length greater than the overall length of the adjacent two rows of plank members, thereby forming tensons at each end of said bottom frame portion,
2. nailing and gluing a plurality of stud-forming plank members at their terminating ends to plank members forming the top row of the bottom frame portion, with the stud-forming plank members being positioned substantially perpendicularly to the elongated bottom frame portion,
3. forming a top frame portion by nailing and gluing two rows of elongated plank members in stacked, securely mounted abutting engagement along substantially their entire length, with the top row of the elongated plank members comprising an overall length greater than the overall length of the adjacent underlying row of plank members thereby forming tenons at each end of said top frame portion, 4. nailing and gluing the opposed terminating ends of the stud-forming plank members extending perpendicularly from the bottom frame portion to the plank members forming the lower row of the top frame portion; and 5. nailing and gluing sheathing material to at least one side of the plank members forming the wall members with the top portion of the sheathing material substantially covering the two rows of plank members forming the top frame portion and with the bottom portion of the sheathing material substantially covering the entire three rows of plank members forming the bottom frame portion;

I. forming a first interior mortise zone in one of the plank members forming the top row of the top frame portion of the second wall member at an interiorly spaced position along the length thereof;

J. forming a cooperating, second interior mortise zone in one of the plank members forming the middle row of the bottom frame portion of the second wall member with said second mortise zone being vertically aligned with the first interior mortise zone;

K. forming a third and fourth interior mortise zone in the top frame portions and lower frame portions of the juxtaposed, spaced, facing fourth wall member, said third and fourth interior mortise zone being in cooperating, vertical aligned relationship with the first and second interior mortise zone; and L. securely mounting and affixing the tenons of the interior wall member with the interior mortise zones of the second and fourth wall members, by nailing and gluing the tenon members in the mortise zones, thereby creating a securely mounted interior wall extending between the second and fourth wall members.

4. The method for constructing a floorless, pre-assembled, relocatable building as defined in claim 3 comprising the additional steps of M. installing plumbing, heating and cooling means throughout the interior of the building, and N. mounting all fixtures directly to the wall members and connecting said fixtures to the plumbing means, thereby attaining a fully constructed building with a completed interior ready for use upon transportation of the completed building from the off-site factory to the site-prepared foundation slab and removal of the building from the transportation means and installation on the foundation slab.

5. The method for constructing a floorless, pre-assembled, relocatable building as defined in claim 4 wherein the method comprises the additional step of:

O. securely affixing a fiberglass layer to the sheathing on the interior walls, thereby attaining an easily cleaned interior surface.

6. The method for constructing a floorless, pre-assembled, relocatable building as defined in claim 3, comprising the additional step of:

M. securely affixing tongue and grooved wall covering means to the outer surfaces of the wall members, by nailing and gluing the tongue and grooved wall covering means to the plank members of the wall members, thereby further enhancing the rigidity of the floorless, pre-assembled, relocatable building.

7. A method for constructing a floorless pre-assembled, relocatable building in an off-site factory which is capable of being transported to a building site, raised from the transportation means and lowered into position on a substantially level, monolithic concrete foundation slab, said method comprising the steps of:

A. constructing a first, self-supporting, wall member comprising a fully interconnected, unitized, assembly formed from a plurality of stud-interconnected, securely joined plank members, all of which are interconnected by rigidifying sheathing, and having a length equal to the entire, overall, outside dimension of one side of the building, said first wall member being constructed by 1. forming a bottom frame portion by nailing and gluing three rows of elongated plank members in stacked, secure, mounted abutting engagement with each other, the middle row of elongated plank members comprising an overall length greater than the overall length of the adjacent two rows of plank members, thereby forming tenons at each end of said bottom frame portion, 2. nailing and gluing a plurality of stud-forming plank members at their terminating ends to the plank members forming the top row of the bottom frame portion, with said stud-forming plank members being positioned substantially perpendicularly to the elongated bottom frame portion, 3. forming a top frame portion by nailing and gluing two rows of elongated plank members in stacked, securely mounted abutting engagement along substantially their entire length, with the top row of the elongated plank members having an overall length greater than the overall length of the adjacent underlying row of plank members, thereby forming tenons at each end of said top frame portion, 4. nailing and gluing the opposed terminating end of the plank members extending perpendicularly from the bottom frame portion to the plank member forming the lower row of the top frame portion; and 5. nailing and gluing sheathing material to at least one side of the stud-forming plank members forming the wall member, with the top portion of the sheathing material substantially covering the two rows of plank members forming the top frame portion and with the bottom portion of the sheathing material substantially covering the entire three rows of plank members forming the bottom frame portion;

B. constructing a second, self-supporting wall member comprising a fully interconnected, unitized, assembly formed from a plurality of interconnected, securely joined plank members, all of which are interconnected by rigidifying sheathing and having a length equal to the entire, overall, outside dimension of one side of the building, the second wall member being constructed by 1. forming a bottom frame portion by nailing and gluing three rows of elongated plank members in stacked, secure, mounted abutting engagement with each other, the middle row of the elongated plank members comprising an overall length less than the overall length of the adjacent two rows of plank members, thereby forming mortise zones at each end of said bottom frame portion, 2. nailing and gluing a plurality of stud-forming plank members at their terminating ends to be plank members forming the top row of the bottom frame portion, with said stud-forming plank members being positioned substantially perpendicularly to the elongated bottom frame portion,
3. forming a top frame portion by nailing and gluing two rows of elongated plank members in stacked, securely mounted abutting engagement along substantially their entire length, with the top row of elongated plank members comprising an overall length less than the overall length of the adjacent underlying rows of plank members, thereby forming mortise zones at each end of said top frame portion,
4. nailing and gluing the opposed terminating ends of the stud-forming plank members extending perpendicularly from the bottom frame portion to the plank members forming the lower row of the top frame portion portion, and
5. nailing and gluing sheathing material to the plank members forming a wall member, with the top portion of the sheathing material substantially covering the two rows of plank members forming the top frame portion and the bottom portion of the sheathing material substantially covering the entire three rows of plank members from the bottom frame portion, C. securely interconnectedly affixing two of the tenons along one side of the first wall member to two of the mortises along one side of the second wall member by nailing and gluing said tenons in said mortises;

D. constructing a third wall member substantially identically to the first wall member;

E. constructing a fourth wall member substantially identically to the second wall member;

F. constructing a self-supporting, interior wall member comprising a fully interconnected, unitized, assembly formed from a plurality of interconnected, securely joined plank members, all of which are interconnected by rigidifying sheathing and having a length substantially equal to the entire, overall, interior dimension of one side of the building, said interior wall member being constructed by 1. forming a bottom frame portion by nailing and gluing three rows of elongated plank members in stacked, secure, mounted abutting engagement with each other, the middle row of elongated plank members comprising an overall length greater than the overall length of the adjacent two rows of plank members, thereby forming tenons at each end of said bottom frame portion,
2. nailing and gluing a plurality of stud-forming plank members at their terminating ends to plank members forming the top row of the bottom frame portion, with the stud-forming plank members being positioned substantially perpendicularly to the elongated bottom frame portion,
3. forming a top frame portion by nailing and gluing two rows of elongated plank members in stacked, securely mounted abutting engagement along substantially their entire length, with the top row of the elongated plank members comprising an overall length greater than the overall length of the adjacent underlying row of plank members thereby forming tenons at each end of said top frame portion,
4. nailing and gluing the opposed terminating ends of the stud-forming plank members extending perpendicularly from the bottom frame portion to the plank members forming the lower row of the top frame portion; and
5. nailing and gluing sheathing material to at least one side of the plank members forming the wall member with the top portion of the sheathing material substantially covering the two rows of plank members forming the top frame portion and with the bottom portion of the sheathing material substantially covering the entire three rows of plank members forming the bottom frame portion;

G. forming a first interior mortise zone in one of the plank members forming the top row of the top frame portion of the second wall member at an interiorly spaced position along the length thereof;

H. forming a cooperating, second interior mortise zone in one of the plank members forming the middle row of the bottom frame portion of the second wall member with said second mortise zone being vertically aligned with the first interior mortise zone;

I. forming a third and fourth interior mortise zone in the top frame portions and lower frame portions of the juxtaposed, spaced, facing fourth wall member, said third and fourth interior mortise zone being in cooperating, vertical aligned relationship with the first and second interior mortise zone; and J. interconnecting and securely affixing said third wall and said fourth wall member to the interconnected, first and second wall members and interior wall member by nailing and gluing the mating tenons and mortises thereof;

K. securely affixing a roof means to the top plank row of the top frame portion;

L. securely affixing a fiberglass layer to the sheathing on the interior walls, thereby attaining an easily cleaned interior surface;

M. installing plumbing, heating and cooling means throughout the interior of the building; and N. mounting all fixtures directly to the wall members and connecting said fixtures to the plumbing means, thereby attaining a fully constructed building with a completed interior ready for use upon transportation of the completed building from the off-site factory to the site-prepared foundation slab and removal of the building from the transportation means and installation on the foundation slab;

O. securely affixing tongue and glued wall covering means to the outer surfaces of the wall members by nailing and gluing the tongue and grooved wall covering means to the plank members of the wall members, thereby further enhancing the rigidity of the floorless, pre-assembled, relocatable building;

P. forming a substantially level, monolithic, concrete foundation slab in a particular location where the floorless, pre-assembled, relocatable building is desired;

Q. transporting the floorless, pre-assembled, relocatable building from the off-site factory to the site of the building location;

R. lifting the building in its entirety from the transportation means;

S. lowering the building in position onto the preconstructed, substantially level, monolithic, concrete foundation slab; and T. bolting the building in position to the concrete foundation slab.

8. A method for constructing a floorless, pre-assembled, relocatable building in an off-site factory which is capable of being transported to a building site, raised from a transportation means and lowered into position on a substantially level, monolithic, concrete foundation slab, said method comprising the steps of:

A. constructing an integrated, lower frame assembly
1. having the overall size and shape of the building desired, and
2. comprising two rows of elongated plank members in stacked, secure, mounted abutting engagement with each other with the rows of elongated plank members being nailed and glued to each other, along substantially their entire abuttingly engaged length;

B. constructing a first, self-supporting wall member
1. comprising a fully interconnected, unitized, assembly formed from a plurality of interconnected, securely joined plank members, all of which are interconnected by rigidifying sheathing, and
2. having a length equal to the entire, overall, dimension of one side of the integrated, lower frame assembly;

C. constructing a second, self-supporting wall member
1. comprising a fully interconnected, unitized, assembly formed from a plurality of interconnected, securely joined plank members, all of which are interconnected by rigidifying sheathing, and
2. having a length equal to the length of another side of the integrated, lower frame assembly;

D. securely mounting the first wall member to the integrated lower frame assembly by nailing and gluing a bottom elongated plank member thereof directly to the top of the upper row of plank members forming the integrated, lower frame assembly along one side thereof;

E. securely affixing the second wall member to the integrated lower frame assembly along its corresponding side by nailing and gluing a lowermost plank member of the wall member directly to the top row of elongated plank members of the frame assembly;

F. nailing and gluing the directly abutting edges of the second wall member with the edges of the first wall member, thereby assuring its secure, integrated engagement therewith;

G. constructing additional self-supporting wall members for each of the additional sides of the lower frame assembly; and H. securely affixing the additional wall members to the corresponding side of the integrated lower frame assembly in the manner described above, thereby completing the overall construction of the floorless, pre-assembled, relocatable building.

9. A method for construction a floorless, pre-assembled, relocatable building in an off-site factory, which is capable of being transported to a building site, raised from a transporation means and lowered into position on a substantially level, monolithic concrete foundation slab, said method comprising the steps of:

A. constructing an integrated, rectangularly shaped, lower frame assembly;
1. having the overall size of the building desired,
2. comprising two rows of elongated plank members in stacked, secure, abutting engagement with each other, with said plank members being both nailed and glued to each other along substantially their entire abutting length,
3. the first pair of the juxtaposed, spaced, facing elongated plank members defining the two longer sides of the lower frame assembly and having a top row of plank members comprising an overall length less than the overall length of the bottom row of plank members, and
4. the second pair of juxtaposed, spaced, facing plank members defining the two shorter sides of the lower frame assembly and having a top row of plank members comprising an overall length greater than the bottom row of plank members in abutting contact therewith, with each corner of said integrated, lower frame assembly having the longer plank members completely filling the space vacated by the shorter row of plank members, thereby achieving a fully integrated, securely rigidified, integrated lower frame assembly;

B. constructing a first, self-supporting wall member comprising a fully interconnected, unitized assembly formed from a plurality of interconnected, securely joined plank and stud members, all of which are interconnected by ridigidying sheathing, and having a length equal to the entire, overall, inside dimension of the second pair of plank members forming the lower frame assembly, said first wall member being constructed by
1. forming an upper frame portion by nailing and gluing two rows of elongated plank members in stacked, securely mounted abutting engagement along substantially their entire length, with the upper row of elongated plank members having an overall length greater than the overall length of the adjacent, underlying row of plank members, thereby forming tenons at each end of said top frame portion,
2. nailing and gluing a plurality of stud-forming plank members at their terminating ends of the plank members forming the lower row of the top frame portion, with said stud-forming plank members being positioned substantially perpendicularly to the elongated top frame portion,
3. nailing and gluing the opposed terminating end of the stud-forming plank members extending perpendicularly from the top frame portion to an elongated plank member forming the lower frame assembly of said wall member, and
4. nailing and gluing sheathing material to at least one side of the plank members forming the wall member, with the top edge of the sheathing material substantially covering the two rows of plank members forming the upper top frame portion, with the bottom edge of the sheathing material extending below the plank member forming the bottom frame edge of the wall member, said sheathing material extending below said plank member a distance substantially equal to the vertical height of the plank members forming the integrated, lower frame assembly;

C. constructing a second, self-supporting wall member comprising a fully interconnected, unitized assembly formed from a plurality of interconnected, securely joined plank members all of which are interconnected by rigidifying sheathing and having a length equal to the entire, overall, outside dimension of the first pair of plank members forming the integrated, lower frame assembly, the second wall member being constructed by 1. forming a top frame portion by nailing and gluing two rows of elongated plank members in stacked, securely mounted abutting engagement along substantially their entire length, with the upper row of elongated plank members comprising an overall length less than the overall length of the adjacent underlying row of plank members, thereby forming mortise zones at each end of said top frame portion,
2. nailing and gluing a plurality of stud-forming plank members at their terminating ends to the plank members forming the bottom row of the top frame portion, with said stud-forming plank members being positioned substantially perpendicularly to the elongated top frame portion,
3. nailing and gluing the opposed terminating ends of the stud-forming plan members extending perpendicularly from the top frame portion to an elongated plank member forming the bottom frame edge of the wall member, and
4. nailing and gluing sheathing material to the plank members forming the wall member with the top edge of the sheathing material substantially covering the two rows of plank members forming the top frame portion and the bottom edge of the sheating material extending below the bottom frame edge of the wall member a distance substantially equal to the vertical height of the two rows of plank members forming the lower frame assembly;

D. securely, interconnectedly, affixing the bottom frame edge of the second wall portion directly to the top row of plank members forming the lower frame assembly along the corresonding side thereof by nailing and gluing the plank member to each other;

E. securely, interconnectedly, affixing the first wall member to the second wall member and the lower frame assembly by 1. nailing and gluing the plank member defining the bottom frame edge of the wall member to the top row of plank members defining the lower frame assembly along the desired side thereof
2. nailing and gluing the tenon of the first wall member to the corresponding, mating mortise of the second wall member, and
3. nailing and gluing the terminating, outside side edges of the first wall member directly to the abutting inside surface of the second wall member;

F. constructing a third wall member substantially identically to the first wall member;

G. constructing a fourth wall member substantially identical to the second wall member;

H. interconnecting and securely affixing said fourth wall member and said third wall member to the interconnected, first and second wall members by nailing and gluing the mating tenon and mortises thereof, as well as the directly abutting side edges thereof as stated above;

I. securely affixing roof means to the top row of plank members of the top frame portion, thereby obtaining a floorless, pre-assembled, relocatable building constructed in an off-site factory, ready for being transported to a building site, raised from the transportation means, and lowered into position on a concrete, substantially level, monolithic foundation and slab, without causing any degradation to the building structure.

10. A method for constructing a floorless, pre-assembled, relocatable building in an off-site factory as defined in claim 9, comprising the additional steps of:

J. constructing an interior wall supporting frame section by nailing and gluing two rows of elongated plank members to the first pair of plank members forming the lower frame assembly, with the top row of interior, wall-supporting plank members comprising an overall length equal to the overall length of the outside dimension of the second pair of plank members of the lower frame assembly and the lower row of plank members comprising an overall length equal to the inside dimension of the second pair of plank members of the lower frame assembly;

K. nailing and gluing the terminating ends of the plank members forming the lower row thereof to the plank members forming the lower row of the lower frame assembly;

L. forming mortise zones in juxtaposed, spaced, cooperating relationship in the top row of plank members forming the first pair of plank members of lower frame assembly on opposed sides thereof and positioned for cooperative interengagement with said interior wall frame supporting member;

M. nailing and gluing the interior wall supporting frame member to the lower frame assembly by nailing and gluing the two rows of plank members thereof to the two rows of plank members forming the lower frame assembly with the tenon portion at opposed ends thereof being nailed and glued to the accommodating mortise zones in the top row of plank members of the lower frame assembly;

N. constructing a self-supporting interior wall member comprising a fully interconnected, unitized assembly formed from a plurality of interconnected, securely joined plank members, all of which are interconnected by rigidifying sheathing and having a length substantially equal to the inside dimension of the second pair of plank members forming the lower frame assembly, said interior wall member being constructed by 1. forming a top frame portion by nailing and gluing two rows of elongated plank members in stacked, securely mounted abutting engagement along substantially their entire length, with the top row of elongated plank members comprising an overall length greater than the overall length of the adjacent underlying row of plank members, thereby forming tenons at each end of said top frame portion,
2. nailing and gluing a plurality of stud-forming plank members at their terminating ends to the plank members forming the lower row of the top frame portion, with the stud-forming plank members being positioned substantially perpendicularly to the elongated top frame portion, 3. nailing and gluing the opposed terminating ends of the stud-forming plank members extending perpendicularly from the top frame portion to an elongated plank member forming the bottom frame edge of the wall member, and
4. nailing and gluing sheathing material to at least one side of the plank members forming the wall members with the top portion of the sheathing material substantially covering the two rows of plank members forming the top frame portion and with the bottom portion of the sheathing material extending below the bottom frame edge of the wall member a distance substantially equal to the vertical height of the two rows of plank members forming the lower frame assembly;

O. forming a first interior mortise zone in one of the plank members forming the top row of the top frame portion of the second wall member at an interiorly spaced position along the length thereof;

P. securely mounting and affixing the interior wall member to the lower frame assembly by
1. nailing and gluing the plank member defining the bottom frame edge of the interior wall member to the top row of plank members of the lower frame assembly,
2. nailing and gluing the terminating side edges of the stud-forming plank members of the interior wall portion to the first wall member along their substantially vertical abutting engagement zone, and
3. nailing and gluing the tenon portion of the interior wall member to the mortise zone formed in the plank member of the second wall member.

11. A method for constructing a floorless, pre-assembled, relocatable building in an off-site factory as defined in claim 9, wherein said second wall member is further defined as comprising sheathing material securely mounted thereto with the terminating side edges thereof being substantially aligned with the terminating ends of the plank members forming the top row of the top frame portion, thereby having stud-forming members extending therebeyond and incorporating the mortise zones on both opposed ends thereof which are not covered with sheathing material and said sheathing material is further defined as being securely affixed to the second wall member completely covering all the stud-forming plank members thereof, whereby the secure interengagement of the wall members on the lower frame assembly is achieved with the sheathing material of the first wall member and the second wall member directly abutting each other, without overlapping engagement thereof and without causing unwanted gaps therebetween.

12. The method defined in claim 10, comprising the additional steps of

Q. forming a substantially level, monolithic, concrete foundation slab in a particular location where the floorless, pre-assembled, relocatable building is desired;

R. transporting the floorless, pre-assembled, relocatable building from the off-site factory to the site of the building location;

S. lifting the building in its entirety from the transportation means;

T. lowering the building in position onto the preconstructed, substantially level, monolithic, concrete foundation slab; and U. bolting the building in position to the concrete foundation slab.

13. The method for constructing a floorless, pre-assembled, relocatable building as defined in claim 12 comprising the additional steps of V. installing plumbing, heating and cooling means throughout the interior of the building, and W. mounting all fixtures directly to the wall members and connecting said fixtures to the plumbing means, thereby attaining a fully constructed building with a completed interior ready for use upon transportation of the completed building from the off-site factory to the site-prepared foundation slab and removal of the building from the transportation means and installation on the foundation slab.

14. The method for constructing a floorless, pre-assembled, relocatable building as defined in claim 13 wherein the method comprises the additional step of:

X. securely affixing a fiberglass layer to the sheathing on the interior walls, thereby attaining an easily cleaned interior surface.

15. The method for constructing a floorless, pre-assembled, relocatable building as defined in claim 9, comprising the additional step of:

J. securely affixing tongue and glued wall covering means to the outer surfaces of the wall members, by nailing and gluing the tongue and grooved wall covering means to the plank members of the wall members, thereby further enhancing the rigidity of the floorless, pre-assembled, relocatable building.

* * * * *